US012623827B2

(12) United States Patent
Vroon

(10) Patent No.: US 12,623,827 B2
(45) Date of Patent: May 12, 2026

(54) RAIL SUPPORT ASSEMBLY FOR A TRANSPORTATION OR STORAGE CONTAINER

(71) Applicant: BRADFORD COMPANY, Holland, MI (US)

(72) Inventor: William J. Vroon, Holland, MI (US)

(73) Assignee: BRADFORD COMPANY, Holland, MI (US)

( * ) Notice: Subject to any disclaimer, the term of this patent is extended or adjusted under 35 U.S.C. 154(b) by 95 days.

(21) Appl. No.: 18/808,720

(22) Filed: Aug. 19, 2024

(65) Prior Publication Data

US 2024/0409294 A1 Dec. 12, 2024

Related U.S. Application Data

(63) Continuation-in-part of application No. 17/633,381, filed as application No. PCT/US2020/059063 on Nov. 5, 2020, now Pat. No. 12,097,994.

(Continued)

(51) Int. Cl.

*B65D 81/05* (2006.01)
*B65D 19/02* (2006.01)

(Continued)

(52) U.S. Cl.

CPC ..... *B65D 81/05* (2013.01); *B65D 19/02* (2013.01); *B65D 19/385* (2013.01); *B65D 19/44* (2013.01); *B65D 2519/0082* (2013.01)

(58) Field of Classification Search

CPC ..... B65D 19/385; B65D 81/05; B65D 2519/00502; B65D 2519/00532;

(Continued)

(56) References Cited

U.S. PATENT DOCUMENTS 3,938,870 A 2/1976 Guest
4,102,470 A 7/1978 Timmons (Continued)

FOREIGN PATENT DOCUMENTS

CZ 33187 U1 9/2019
DE 202015100895 U1 3/2015
GB 2552395 A 1/2018

OTHER PUBLICATIONS

Supplemental European Search Report for counterpart European Patent Application No. 20885407.5 dated Nov. 13, 2023 (6 pages).

(Continued)

*Primary Examiner* — Rafael A Ortiz
(74) *Attorney, Agent, or Firm* — Barnes & Thornburg LLP

(57) ABSTRACT

A dunnage support assembly for a transportation or storage container may include pair of panels each defining a flange at a top end thereof, the panels being configured to be received within a transportation or storage container with the flanges of the panels supported on and by respective, opposite side walls of the container, and means for coupling the flanges to the respective side walls. One or more transverse support rails are secured to the each panel and are configured to support a plurality of dunnage pouches therebetween and slidable relative thereto. In some embodiments the panels may be provided in the form of at least two panel strips each defining a respective flange at a top end thereof.

20 Claims, 11 Drawing Sheets

Related U.S. Application Data

(60) Provisional application No. 62/931,899, filed on Nov. 7, 2019.

(51) Int. Cl.
*B65D 19/38* (2006.01)
*B65D 19/44* (2006.01)

(58) Field of Classification Search
CPC ..... B65D 88/546; B65D 19/36; B65D 2519/0082; A47B 63/00; B42F 15/0011
USPC ..... 206/521, 583, 1.6, 425, 544
See application file for complete search history.

(56) References Cited

U.S. PATENT DOCUMENTS

| | | | | |
|---|---|---|---|---|
| 4,527,694 | A | 7/1985 | Bolt et al. | |
| 5,678,797 | A | 10/1997 | Gogan et al. | |
| 5,815,903 | A * | 10/1998 | Foster | B42F 15/04 29/401.1 |
| 8,833,881 | B2 | 9/2014 | Manniso | |
| 9,468,313 | B2 | 10/2016 | Kniffen | |
| 9,527,613 | B2 * | 12/2016 | Bazany | B65D 85/68 |
| 9,988,208 | B2 * | 6/2018 | Sanger | B65D 88/546 |
| 2003/0123965 | A1 | 7/2003 | Brackmann et al. | |
| 2006/0145037 | A1 | 7/2006 | Sloan | |
| 2010/0122981 | A1 | 5/2010 | Sims | |
| 2013/0126383 | A1 | 5/2013 | Bradford | |
| 2013/0175912 | A1 | 7/2013 | Bradford | |
| 2015/0069053 | A1 | 3/2015 | Bradford | |
| 2015/0090722 | A1 | 4/2015 | Sanger | |
| 2015/0101956 | A1 * | 4/2015 | Dobrinski | B65D 90/12 206/591 |
| 2015/0259098 | A1 * | 9/2015 | Sanger | B65D 88/12 220/544 |
| 2015/0259135 | A1 | 9/2015 | Sanger | |
| 2018/0319534 | A1 * | 11/2018 | Vermeulen | B65D 19/38 |
| 2020/0407114 | A1 * | 12/2020 | Knob | B65D 21/086 |

OTHER PUBLICATIONS

PCT International Search Report and Written Opinion completed by the ISA/US on Dec. 26, 2020 and issued in connection with PCT/US2020/059063.

* cited by examiner

RAIL SUPPORT ASSEMBLY FOR A TRANSPORTATION OR STORAGE CONTAINER

CROSS-REFERENCE TO RELATED APPLICATIONS

This is a continuation-in-part of U.S. patent application Ser. No. 17/633,381, filed Feb. 7, 2022, which is a U.S. national stage entry of International Application Serial No. PCT/US2020/059063, filed Nov. 5, 2020, which claims the benefit of and priority to U.S. Provisional Patent Application Ser. No. 62/931,899, filed Nov. 7, 2019, the disclosures of which are all expressly incorporated herein by reference in their entireties.

FIELD OF THE INVENTION

This disclosure relates generally to transportation and/or storage containers, and more specifically to support assemblies for supporting dunnage and cargo in such containers.

BACKGROUND

Conventional transportation and/or storage containers typically include dunnage to support and protect cargo, i.e., a plurality of parts or components, during shipping and/or storage. Some such containers, sometimes referred to as pallet boxes, are equipped with a dunnage support assembly configured to support a plurality of sliding dunnage pouches. An example of one such conventional transportation and/or storage container 10 is illustrated in FIG. 1, and includes a conventional, four-sided pallet box 12 having a closed bottom and an open top, and a conventional dunnage support assembly 14 configured to support a plurality of sliding dunnage pouches 16. Referring to FIGS. 2A and 2B, the dunnage support assembly includes a pair of dunnage support frames 14A, 14B and four corner frame components 22A-22D, all mounted to and within the container 12. The support frames 14A, 14B each include two spaced-apart, vertically oriented support strips 18A, 18B to which one or more elongated, horizontally oriented dunnage support rails is/are secured. In the illustrated example, three such dunnage support rails 20A, 20B, 20C are mounted in vertically space-apart relationship to the support strips 18A, 18B of each frame 14A, 14B.

The dunnage support assembly 14 is conventionally secured to the sides of the container 12 via a number of fasteners extending through the support strips 18A, 18B and the corner frame components 22A-22D and through the sides of the container 12. This conventional arrangement, however, is problematic for any of several reasons. As one non-limiting example, containers 12 are typically plastic and include a number of support ribs running along the exterior surfaces thereof, and such containers may have different support rib configurations and placement thereof relative to the container side walls. This typically requires different support frame configurations and/or modifications thereto in order to mount and secure the dunnage support assembly 14 to and within any particular container 12.

As another non-limiting example, the weight of the combination of the dunnage support assembly 14 and cargo contained therein is necessarily borne by the side walls of the container at the through-hole locations where the assembly 14 is secured via fixation members. Over time, the through-holes may become worn and/or damaged such that the pallet box may no longer be usable. This same effect may occur due to multiple reconfiguring/mounting of dunnage support assemblies to and with a pallet box.

As a further non-limiting example, pallet boxes may become damaged due to externally induced trauma, and in some cases it may become necessary to remove the dunnage frame assembly and remount it in an undamaged pallet box. This can be undesirably time consuming as the dunnage frame assembly must be disassembled, removed from the damaged container and then reassembled and mounted to and within a different container which must typically be prepared in advance by providing the plurality of through-holes at various locations. This time consuming process is exacerbated, of course, if cargo must first be removed from the damaged pallet box and then repacked in the different container to and within which the dunnage frame assembly has been mounted.

In view of the foregoing and/or other problems associated with the dunnage support assembly 14 illustrated in FIGS. 1-2B, it is desirable to design dunnage support assemblies that do not suffer from one or more such drawbacks.

SUMMARY

This disclosure may comprise one or more of the features recited in the attached claims, and/or one or more of the following features and combinations thereof. In a first aspect, a dunnage support assembly for a transportation or storage container may comprise a first panel defining a first flange at a top end thereof, the first flange running at least partially along a length of the first panel, the first panel configured to be received within a transportation or storage container with the first flange received on a top edge of one side wall thereof such that the first panel is supported by the first flange on and by the one side wall, a first plurality of elongated securement members affixed to, or configured to extend through, the first flange, such that each of the first plurality of elongated securement members is positioned along the first flange so as to extend into a corresponding one of a plurality of openings formed in the top edge of the one side wall as the first flange is received on the top edge of the one side wall, a second panel defining a second flange at a top end thereof, the second flange running at least partially along a length of the second panel, the second panel configured to be received within the transportation or storage container with the second flange received on a top edge of another side wall, opposite the one side wall, such that the second panel is supported by the second flange on and by the another side wall, a second plurality of elongated securement members affixed to, or configured to extend through, the second flange, such that each of the second plurality of elongated securement members is positioned along the second flange so as to extend into a corresponding one of a plurality of openings formed in the top edge of the another side wall as the second flange is received on the top edge of the another side wall, one or more first elongated support rails secured to the first panel and oriented to be substantially parallel with the top edge of the one side wall, and one or more second elongated support rails secured to the second panel and oriented to be substantially parallel with the top edge of the another sidewall, wherein opposing pairs of the one or more first and second elongated support rails are configured to support a respective plurality of dunnage pouches therebetween and slidable relative thereto.

A second aspect includes the features of the first aspect, and wherein the first panel may comprise at least two spaced apart panel strips each defining a separate first flange at a top end thereof, the at least two panel strips of the first panel secured together by the one or more first elongated support rails.

A third aspect includes the features of the second aspect, and wherein the second panel may comprise at least two spaced apart panel strips each defining a separate second flange at a top end thereof, the at least two panel strips of the second panel secured together by the one or more second elongated support rails.

A fourth aspect includes the features of the first aspect, and wherein a downwardly-facing surface of the first flange and an adjacent inner surface of the first panel together define an single-sided channel configured to be received on the one side wall with the first flange supported on the top edge of the one side wall and with the inner surface of the first panel received against an inner surface of the one side wall facing an interior of the container.

A fifth aspect includes the features of the fourth aspect, and wherein a downwardly-facing surface of the second flange and an adjacent inner surface of the second panel together define a single-sided channel configured to be received on the another side wall with the second flange supported on the top edge of the another side wall and with the inner surface of the second panel received against an inner surface of the another side wall facing the interior of the container.

A sixth aspect includes the features of the first aspect, and wherein the first plurality of elongated securement members may each comprise an elongated pin affixed to the first flange so as to extend downwardly away from a downwardly-facing surface of the first flange.

A seventh aspect includes the features of the sixth aspect, and wherein the second plurality of elongated securement members may each comprise an elongated pin affixed to the second flange so as to extend downwardly away from downwardly-facing surface of the second flange.

An eighth aspect includes the features of the seventh aspect, and wherein the first plurality of elongated securement members may include at least a first elongated pin affixed to the first flange at or near one end of the first flange, and at least a second elongated pin affixed to the first flange at or near an opposite end of the first flange, and wherein the second plurality of elongated securement members may include at least a third elongated pin affixed to the second flange at or near one end of the second flange, and at least a fourth elongated pin affixed to the second flange at or near an opposite end of the second flange.

A ninth aspect includes the features of the first aspect, and wherein the first flange defines therethrough at least two openings spaced apart from one another along the first flange, and wherein the first plurality of elongated securement members may each comprise a shaft portion sized to be received through one of the at least two openings defined through the first flange, and a head portion sized larger than the at least two openings defined through the first flange such that, with the shaft portion of each of the first plurality of elongated securement members extending through a respective one of the at least two openings defined through the first flange, the corresponding head portion is prevented from passing through the respective one of the at least two openings defined through the first flange.

A tenth aspect includes the features of the ninth aspect, and wherein each of the at least two openings defined through the first flange is countersunk such that, with the shaft portion of each of the first plurality of elongated securement members extending through a respective one of the at least two openings defined through the first flange and the corresponding head portion is supported against the first flange, a top surface of each head portion is co-planar with, or extends below, a plane defined by a top surface of the first flange.

An eleventh aspect includes the features of the ninth aspect, and wherein the second flange defines therethrough at least two openings spaced apart from one another along the second flange, and wherein the second plurality of elongated securement members each comprise a shaft portion sized to be received through one of the at least two openings defined through the second flange, and a head portion sized larger than the at least two openings defined through the second flange such that, with the shaft portion of each of the second plurality of elongated securement members extending through a respective one of the at least two openings defined through the second flange, the corresponding head portion is prevented from passing through the respective one of the at least two openings defined through the second flange.

A twelfth aspect includes the features of the eleventh aspect, and wherein each of the at least two openings defined through the second flange is countersunk such that, with the shaft portion of each of the second plurality of elongated securement members extending through a respective one of the at least two openings defined through the second flange and the corresponding head portion supported against the second flange, a top surface of each head portion is co-planar with, or extends below, a plane defined by a top surface of the second flange.

A thirteenth aspect includes the features of the eleventh aspect, and wherein the at least two openings spaced defined through first flange include a first opening at or near one end of the first flange and a second opening at or near an opposite end of the first flange, and wherein the at least two openings spaced defined through second flange include a third opening at or near one end of the second flange and a fourth opening at or near an opposite end of the second flange.

In a fourteenth aspect, a dunnage support assembly for a transportation or storage container may comprise a first assembly including: first and second elongated support strips spaced apart from one another, the first elongated support strip defining a first flange at a top end thereof and the second elongated strip defining a second flange at a top end thereof, one or more first elongated support rails secured transversely to and between the first and second support strips, the first assembly configured to be received within a transportation or storage container with the first and second flanges received on a top edge of one side wall thereof such that the first assembly is supported by the first and second flanges on and by the one side wall, and means for coupling the first and second flanges to the one side wall, and a second assembly including: third and fourth elongated support strips spaced apart from one another, the third elongated support strip defining a third flange at a top end thereof and the fourth elongated strip defining a fourth flange at a top end thereof, one or more second elongated support rails secured transversely to and between the third and fourth support strips, the second assembly configured to be received within the transportation or storage container with the third and fourth flanges received on a top edge of another side wall thereof, opposite the one side wall, such that the second assembly is supported by the third and fourth flanges on and by the another side wall, and means for coupling the third and fourth flanges to the another side wall, wherein the one or more first elongated support rails and the one or more second elongated support rails are configured to support a plurality of dunnage pouches therebetween and slidable relative thereto.

A fifteenth aspect includes the features of the fourteenth aspect, and wherein the means for coupling the first and second flanges to the one side wall may comprise: a first elongated securement member affixed to, or configured to extend through, the first flange, and a second elongated securement member affixed to, or configured to extend through, the second flange, wherein the first and second elongated securement members are positioned to extend into corresponding first and second openings formed in the top edge of the one side wall as the first assembly is received within the transportation or storage container with the first and second flanges supported on the top edge of the one side wall.

A sixteenth aspect includes the features of the fifteenth aspect, and wherein the means for coupling the third and fourth flanges to the another side wall may comprise: a third elongated securement member affixed to, or configured to extend through, the third flange, and a fourth elongated securement member affixed to, or configured to extend through, the fourth flange, wherein the third and fourth elongated securement members are positioned to extend into corresponding third and fourth openings formed in the top edge of the another side wall as the second assembly is received within the transportation or storage container with the third and fourth flanges supported on the top edge of the another side wall.

A seventeenth aspect includes the features of the fourteenth aspect, and wherein the means for coupling the first and second flanges to the one side wall may comprise: a first elongated pin affixed to the first flange so as to extend downwardly away from a downwardly-facing surface of the first flange, and a second elongated pin affixed to the second flange so as to extend downwardly away from a downwardly-facing surface of the second flange, and wherein the means for coupling the third and fourth flanges to the another side wall comprises: a third elongated pin affixed to the third flange so as to extend downwardly away from a downwardly-facing surface of the third flange, and a fourth elongated pin affixed to the fourth flange so as to extend downwardly away from a downwardly-facing surface of the fourth flange, wherein the first and second elongated pins are positioned to extend into corresponding first and second openings formed in the top edge of the one side wall as the first assembly is received within the transportation or storage container with the first and second flanges supported on the top edge of the one side wall, and wherein the third and fourth elongated pins are positioned to extend into corresponding third and fourth openings formed in the top edge of the other side wall as the second assembly is received within the transportation or storage container with the third and fourth flanges supported on the top edge of the another side wall.

An eighteenth aspect includes the features of the fourteenth aspect, and wherein the means for coupling the first and second flanges to the one side wall may comprise: a first opening defined through the first flange, a first elongated securement member having a first shaft portion sized to be received through the first opening, and a first head portion sized larger than the first opening such that, with the first shaft portion extending through the first opening, the first head portion is prevented from passing through the first opening, a second opening defined through the second flange, and a second elongated securement member having a second shaft portion sized to be received through the second openings, and a second head portion sized larger than the second opening such that, with the second shaft portion extending through the second opening, the second head portion is prevented from passing through the third opening, wherein the first and second openings defined through the first and second respective flanges are positioned so as to align with first and second respective openings formed in the top edge of the one side wall as the first assembly is received within the transportation or storage container with the first and second flanges supported on the top edge of the one side wall, such the first and second shaft portions of the first and second respective elongated securement members will pass through the first and second respective openings defined through the first and second respective flanges and into the first and second respective openings formed in the top edge of the one side wall so as to secure the first and second flanges to the top edge of the one side wall.

A nineteenth aspect includes the features of the eighteenth aspect, and wherein the means for coupling the third and fourth flanges to the another side wall may comprise a third opening defined through the third flange, a third elongated securement member having a third shaft portion sized to be received through the third opening, and a third head portion sized larger than the third opening such that, with the third shaft portion extending through the third opening, the third head portion prevented from passing through the third opening, a fourth opening defined through the fourth flange, and a fourth elongated securement member having a fourth shaft portion sized to be received through the fourth openings, and a fourth head portion sized larger than the fourth opening such that, with the fourth shaft portion extending through the fourth opening, the fourth head portion is prevented from passing through the fourth opening, wherein the third and fourth openings defined through the third and fourth respective flanges are positioned so as to align with third and fourth respective openings formed in the top edge of the another side wall as the second assembly is received within the transportation or storage container with the third and fourth flanges supported on the top edge of the another side wall, such the third and fourth shaft portions of the third and fourth respective elongated securement members will pass through the third and fourth respective openings defined through the third and fourth respective flanges and into the third and fourth respective openings formed in the top edge of the another side wall so as to secure the third and fourth flanges to the top edge of the another side wall.

A twentieth aspect includes the features of the nineteenth aspect, and wherein each of the first, second, third and fourth openings defined through the first, second, third and fourth respective flanges is countersunk such that, with the shaft portion of the respective first, second, third, and fourth elongated securement member extending therethrough and the respective first, second, third and fourth head portion supported against the respective first, second, third and fourth flange, a top surface of each of the first, second, third and fourth head portions is co-planar with, or extends below, a plane defined by a top surface of the respective first, second, third and fourth flange.

BRIEF DESCRIPTION OF THE DRAWINGS

This disclosure is illustrated by way of example and not by way of limitation in the accompanying figures. Where considered appropriate, reference labels have been repeated among the figures to indicate corresponding or analogous elements.

DETAILED DESCRIPTION OF THE DRAWINGS

Figure 1:
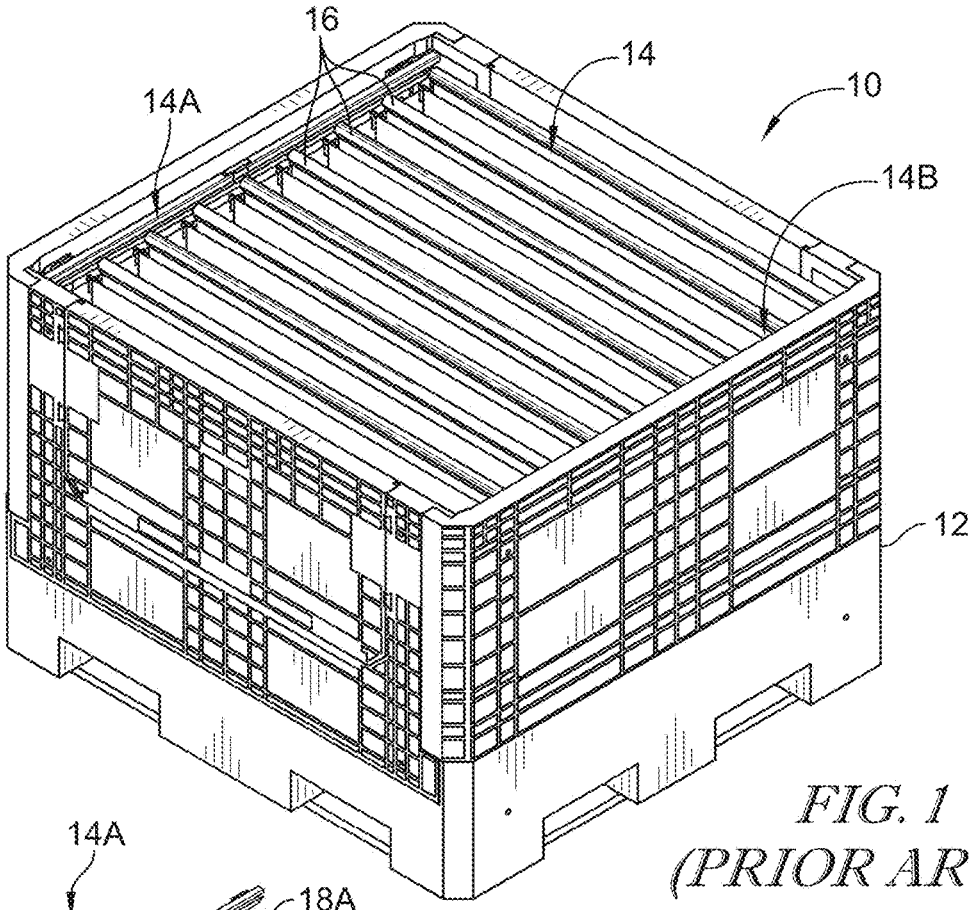
FIG. 1 (PRIOR ART)
FIG. 1 is a perspective view of a dunnage container in which a conventional dunnage support assembly is mounted and which is shown supporting a plurality of sliding dunnage pouches.

While the concepts of the present disclosure are susceptible to various modifications and alternative forms, specific exemplary embodiments thereof have been shown by way of example in the drawing and will herein be described in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases may or may not necessarily refer to the same embodiment. Further, when a particular feature, structure or characteristic is described in connection with an embodiment, it is submitted that it is within the knowledge of one skilled in the art to effect such feature, structure or characteristic in connection with other embodiments whether or not explicitly described. Further still, it is contemplated that any single feature, structure or characteristic disclosed herein may be combined with any one or more other disclosed feature, structure or characteristic, whether or not explicitly described, and that no limitations on the types and/or number of such combinations should therefore be inferred.

This disclosure relates to a rail support system for a transportation and/or storage container. In some of the illustrated examples, the rail support system is shown supporting one or multiple tiers of rigid, slidable rods coupled to cargo pouches, although it will be understood that the rail support system may alternatively be configured to support other dunnage configurations including for example, but not limited to, slidable dunnage with non-rigid (i.e., flexible or semi-flexible) supports coupled to the rail support system, non-slidable dunnage, or the like.

Figure 3A:
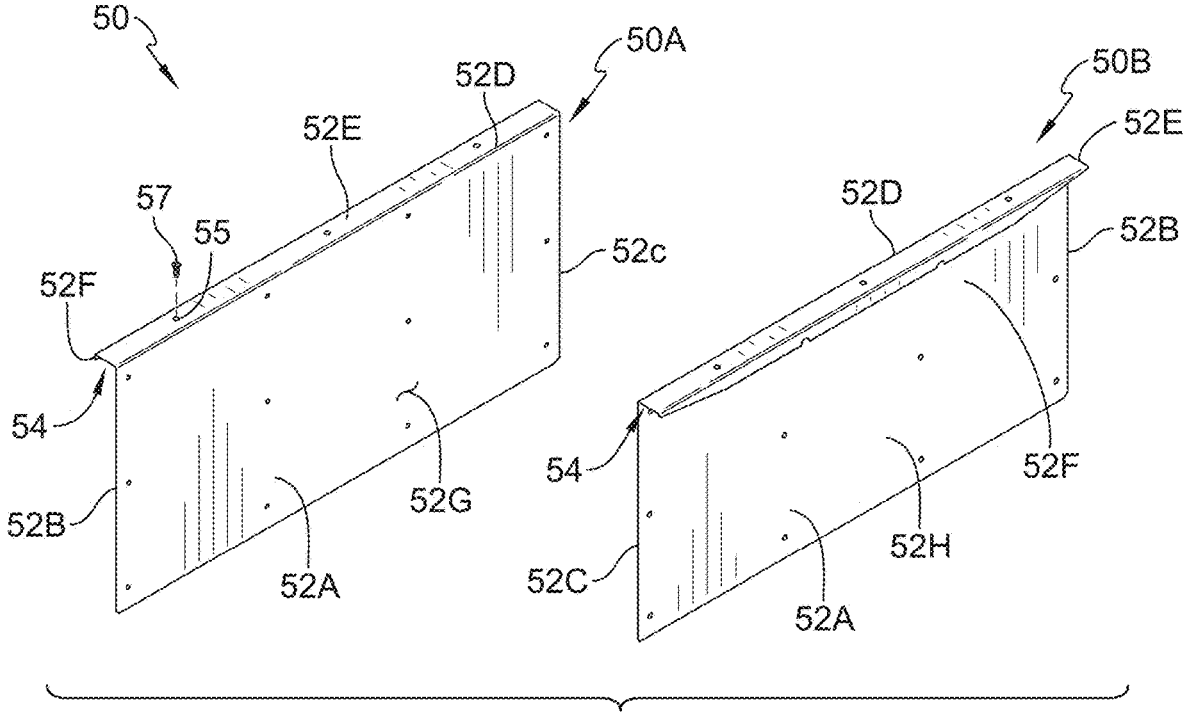
FIG. 3A is a perspective view of an embodiment of a rail support assembly for a transportation and/or storage container of the type illustrated in FIG. 1, shown in the form of an embodiment of a pair of rail support panels configured to be removably coupled to, and supported on top edges of, opposing walls of the container.
Figure 3B:
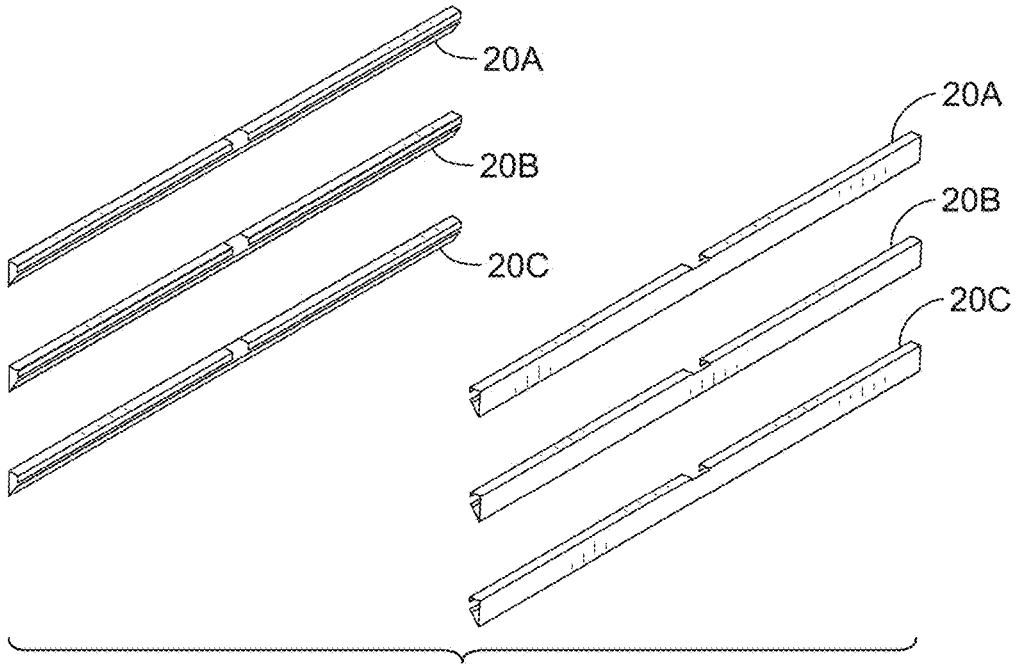
FIG. 3B is a perspective view of an example set of conventional dunnage support rails that may be mounted to the rail support panels of FIG. 3A, in any number and with any spacing therebetween, to form a rail support system supported by and on top of opposing side walls of the transportation and/or storage container.

Referring now to FIGS. 3A and 3B, a dunnage support assembly 50 is shown which is configured to be slidingly received onto opposing side walls of a conventional transportation and/or storage container 12 and to support a plurality of sliding dunnage pouches 16. Referring specifically to FIG. 3A, the dunnage support assembly 50 takes the form of a pair of planar dunnage support panels 50A, 50B each configured to be slidingly received onto a respective side wall of the container 12 such that the support panels 50A, 50B are opposite one another, i.e. are received on opposing side walls of the container 12. Each panel 50A, 50B has a bottom edges 52A, a pair of side edges 52B, 52C opposite one another, a top edge 52D, a front face 52G and a rear face 52H opposite the front face 52G. Integral with, or attached to, the top edge 52D is a planar flange 52E which extends rewardly away from the front face 52G and which illustratively extends the length of the panel 50A, 50B between the side edges 52B, 52C, and integral with, or attached to, a rear edge of the flange 52E is another planar flange 52F which extends downwardly from a rear edge of the flange 52E toward the bottom edge 52A of the panel 50A, 50B at which extends substantially along the length of the panel 50A, 50B. In some embodiments, the flange 52E forms approximately a right angle with the plane defined by the faces 52G, 52H of the panel 50A, 50B, and the flange 52F forms approximately another right angle with a plane defined by the flange 52E such that the inner surfaces of the flanges 52E, 52F and a portion of the rear surface 52H of the panel 50A, 50B forms a channel 54. In some alternate embodiments, the flange 52E and/or the flange 54F may be non-planar, the flange 52E may form an acute or obtuse angle relative to the plane defined by the faces 52G, 52H of the panel 50A, 50B and/or the flange 52F may form an acute or obtuse angle relative to the plane defined by the flange 52E. In some of these alternate embodiments and/or in other alternate embodiments the flange 54F may be omitted such that the interior surface of the flange 54E and the adjacent rear surface 52H of the panel 50A, 50B defines an "L" shape. In such embodiments, the channel 54 is a single-sided channel, i.e., the underside or interior surface of the flange 54E forms a top of the channel 54 and the adjacent rear surface 52H of the panels 50A, 50B forms the side of the channel 54. In some such embodiments, the flange 54E may define one or more openings 55 therein sized and configured to receive a conventional fixation member 57, e.g., screw, bolt or the like, to secure the flange 54E to the top edge 12A of the container 12.

Figure 5:
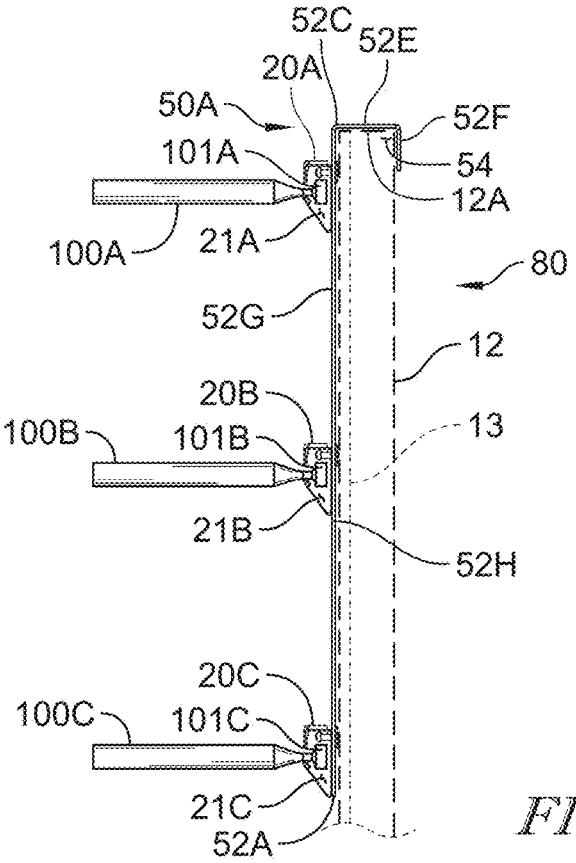
FIG. 5 is a side view of one of the rail support panels of FIG. 3A shown with three spaced-apart dunnage support rails mounted thereto as depicted in FIG. 4C and with a portion of a rigid dunnage pouch support rod slidingly received within each dunnage support rail.
Figure 6:
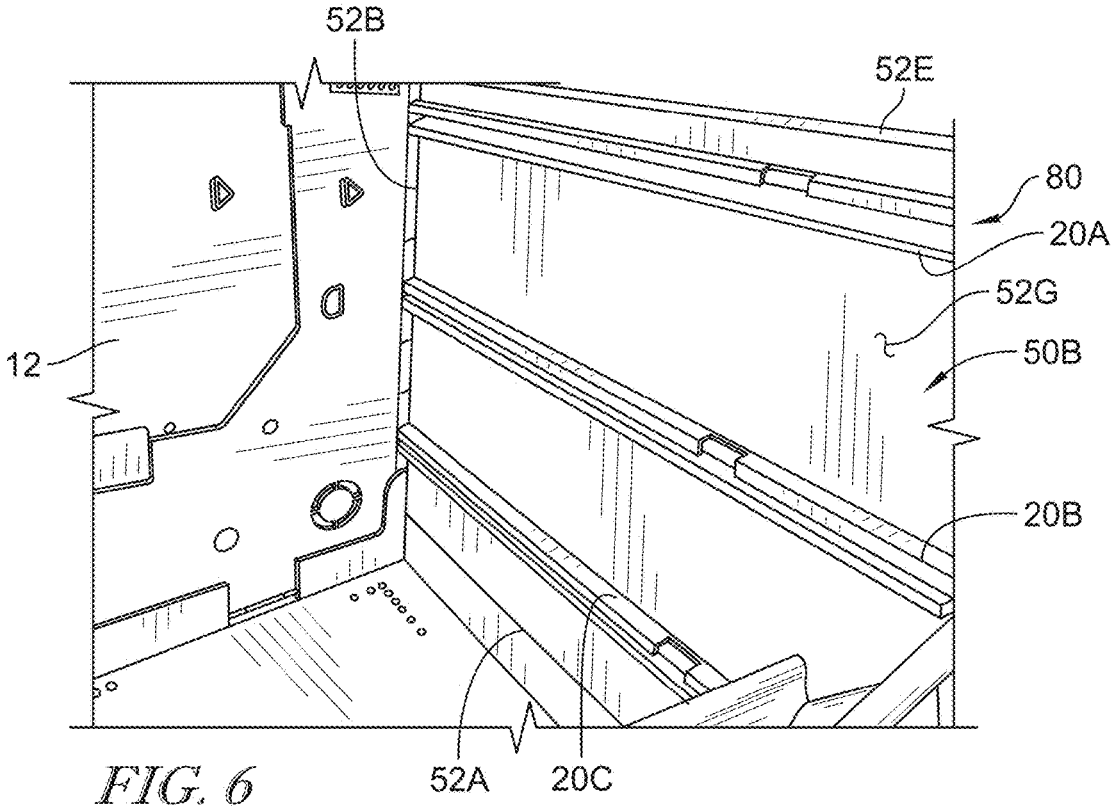
FIG. 6 is a perspective view of the example of FIG. 4C illustrating one of the rail support panels supported on a side wall of the transportation and/or storage container.
Figure 7A:
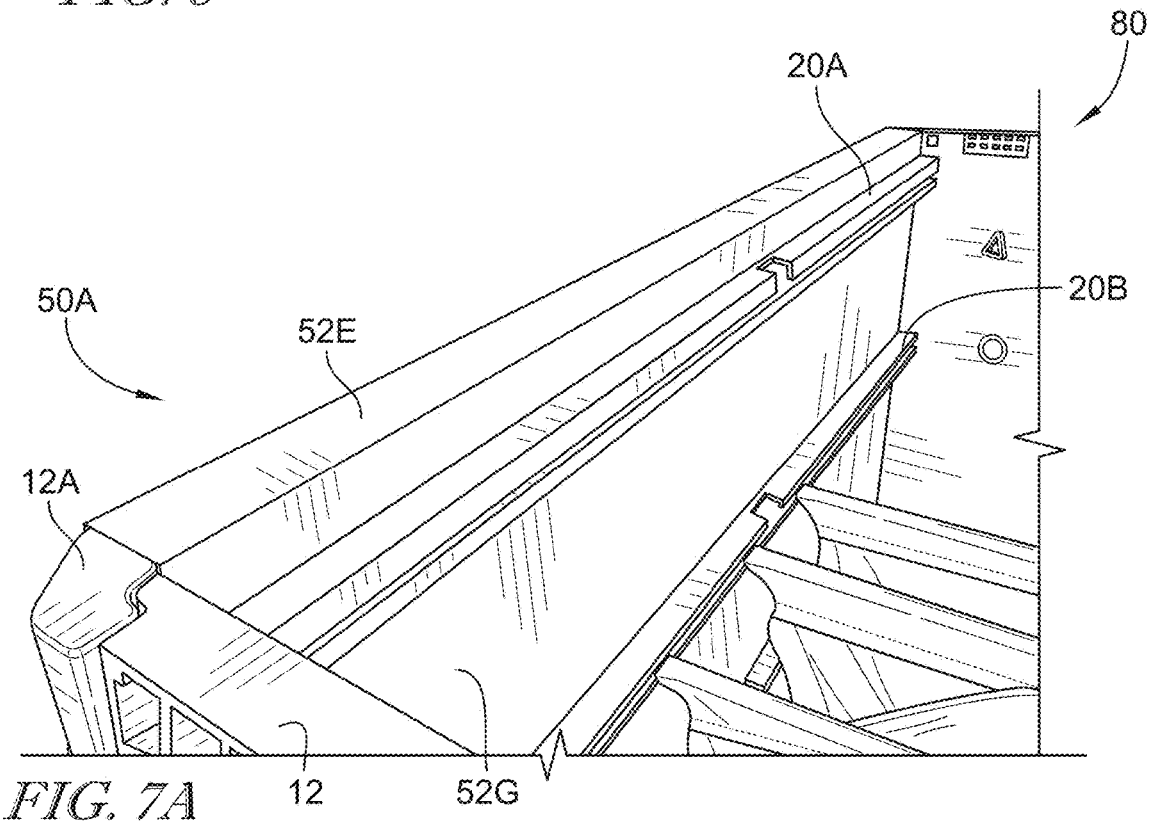
FIG. 7A is another perspective view of the example of FIG. 4C illustrating the other rail support panel supported on an opposite side wall of the transportation and/or storage container and showing a number of sliding dunnage support rods and pouches slidingly received in the middle dunnage support rail.
Figure 7B:
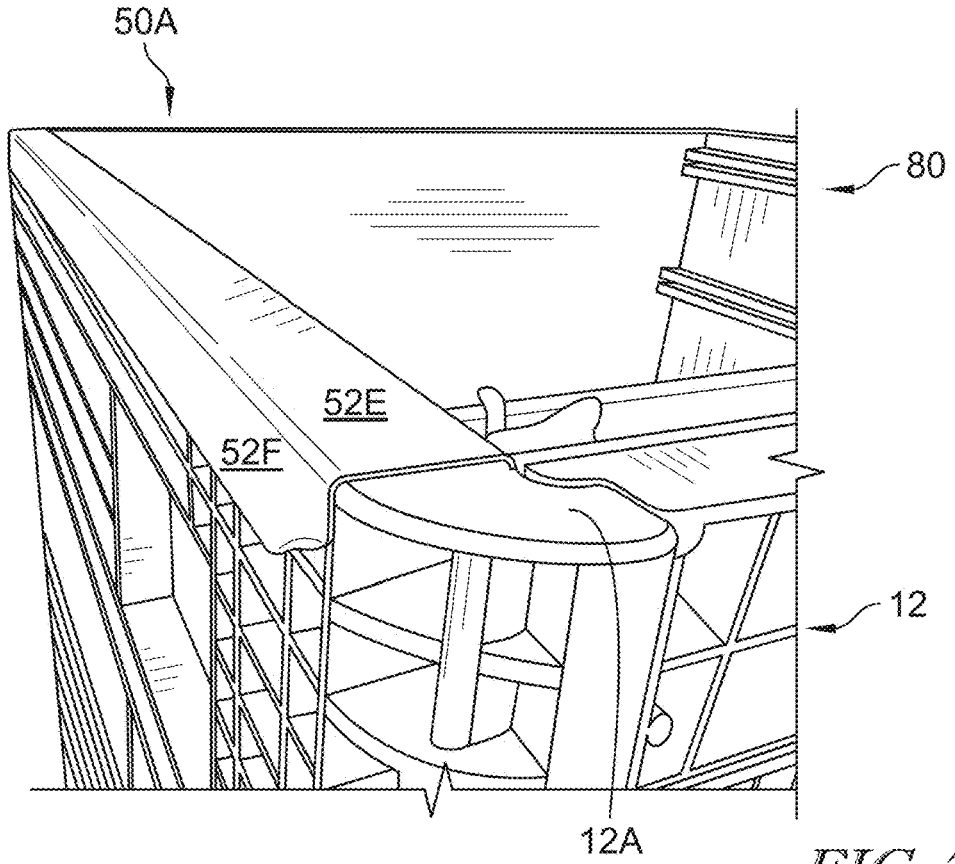
FIG. 7B is yet another perspective view of the example of FIG. 4C showing a magnified view of the channel of the rail support panel received on and supported by a top edge of the side wall of the transportation and/or storage container.

In any case, the panels 50A, 50B are illustratively configured and sized to be received within the container 12 along an inner surface of a respective side wall thereof, and the channel 54 is illustratively configured and sized to be received over and in contact with the top edge 12A of the respective side wall of the container 12 (see, e.g., FIG. 5). The panels 50A, 50B are thus configured to be supported on and by the top edges 12A of the side walls 12. In some embodiments, the panels 50A, 50B are sized and configured such that the bottom edge 52A is planar with and spaced apart from the bottom or floor of the container 12 when received therein and supported on a top edge 12A of a respective side wall, although in alternate embodiments the bottom edge 52A may be non-planar and/or in contact with the bottom or floor of the container 12. In some embodiments, the panels 50A, 50B are sized and configured such that the length of the panels 50A, 50B extend substantially the length of the respective side wall of the container 12, e.g., such that the opposing side edges 52B, 52C of the panel 50A, 50B are adjacent to, or abut, the joining side walls, although in alternate embodiments the length of the panel 50A and/or 50B may be shorter such that the opposing side edges 52B, 52C of the panel 50A, 50B are spaced apart from the joining side walls. In some embodiments, the side edges 52B, 52C are planar, although in alternate embodiments the side edge 52B and/or the side edge 52C may be non-planar.

Figure 4A:
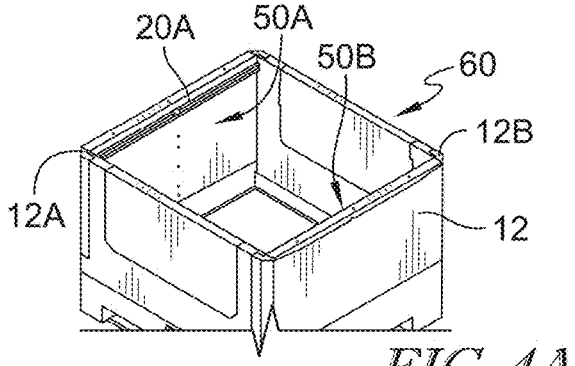
FIG. 4A is a perspective view of an example rail support system received within a conventional transportation and/or storage container and including the rail support panels of FIG. 3A with a single set of opposing dunnage support rails mounted thereto.
Figure 4B:
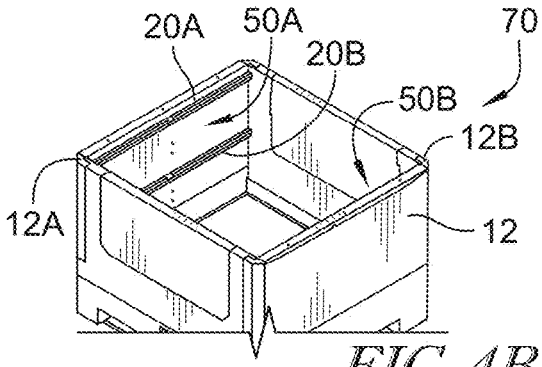
FIG. 4B is a perspective view of another example rail support system received within a conventional transportation and/or storage container and including the rail support panels of FIG. 3A with two spaced-apart sets of opposing dunnage support rails mounted thereto.
Figure 4C:
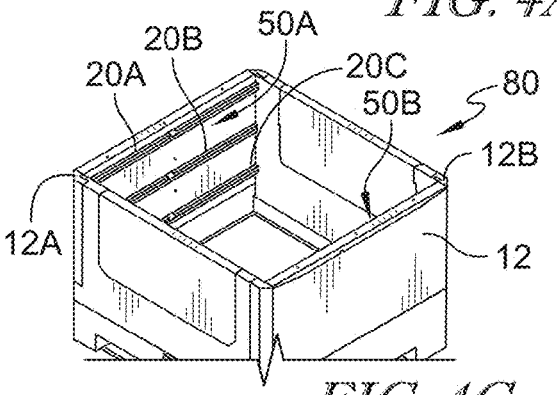
FIG. 4C is a perspective view of yet another example rail support system received within a conventional transportation and/or storage container and including the rail support panels of FIG. 3A with three spaced-apart sets of opposing dunnage support rails mounted thereto.
Figure 4D:
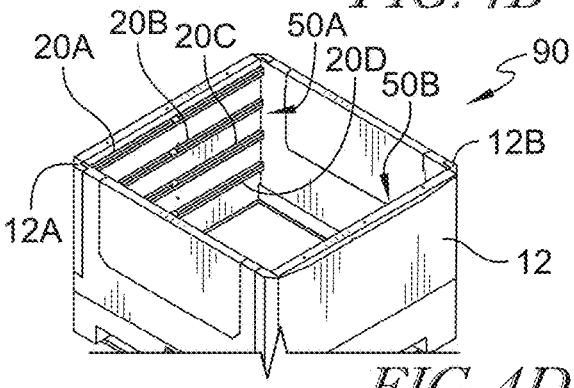
FIG. 4D is a perspective view of still another example rail support system received within a conventional transportation and/or storage container and including the rail support panels of FIG. 3A with four spaced-apart sets of opposing dunnage support rails mounted thereto.

Referring now to FIGS. 3A and 3B, the panels 50A, 50B are illustratively configured, e.g., by providing appropriate through-holes as illustrated by example, to support one or more horizontally-disposed dunnage support rails thereon to complete the dunnage support assembly 50. In the example illustrated in FIG. 3B, three such rails 20A-20C are shown, although it will be understood that more or fewer such rails 20A, 20B may be mounted to and supported on the panels 50A, 50B. For example, referring to FIG. 4A, an embodiment is shown of a dunnage support assembly 60 in which dunnage support panels 50A, 50B are received on opposing walls of a transportation or storage container 12 as described above, and in which a single, horizontally-disposed dunnage support rail 20A is secured to each panel 50A, 50B adjacent to a top of the container 12 so as to provide opposing dunnage support rails 20A on opposite sides of the container 12. In this embodiment, the dunnage support assembly 60 is configured to support a single tier of a plurality of dunnage pouches each supported on the opposing dunnage rails 20A by a respective pair of dunnage support rods (example illustrated in FIG. 5). Referring to FIG. 4B, another embodiment is shown of a dunnage support assembly 70 in which dunnage support panels 50A, 50B are received on opposing walls of a transportation or storage container 12, and in which two horizontally-disposed dunnage support rails 20A, 20B are secured to each panel 50A and vertically spaced apart from one another so as to provide opposing dunnage support rails 20A, 20B on opposite sides of the container 12. In this embodiment, the dunnage support assembly 70 is configured to support two tiers of a plurality of dunnage pouches with each tier supported on the respective opposing dunnage rails 20A and 20B by a respective pair of dunnage support rods. Referring to FIG. 4C, yet another embodiment is shown of a dunnage support assembly 80 in which dunnage support panels 50A, 50B are received on opposing walls of a transportation or storage container 12, and in which three horizontally-disposed dunnage support rails 20A, 20B, 20C are secured to each panel 50A and vertically spaced apart from one another so as to provide opposing dunnage support rails 20A, 20B, 20C on opposite sides of the container 12. In this embodiment, the dunnage support assembly 80 is configured to support three tiers of a plurality of sliding dunnage pouches with each tier supported on the respective opposing dunnage rails 20A, 20B and 20C by a respective pair of dunnage support rods. Referring to FIG. 4D, still another embodiment is shown of a dunnage support assembly 90 in which dunnage support panels 50A, 50B are received on opposing walls of a transportation or storage container 12, and in which four horizontally-disposed dunnage support rails 20A, 20B, 20C, 20D are secured to each panel 50A adjacent to a top of the container 12 and vertically spaced apart from one another so as to provide opposing dunnage support rails 20A, 20B, 20C and 20D on opposite sides of the container 12. In this embodiment, the dunnage support assembly 90 is configured to support four tiers of a plurality of sliding dunnage pouches with each tier supported on the respective opposing dunnage rails 20A, 20B, 20C and 20D by a respective pair of dunnage support rods. It will be understood that the embodiments illustrated in FIGS. 4A-4D are provided only by way of example, and that other embodiments are contemplated which may be configured to support more than four tiers of a plurality of sliding dunnage pouches. It will be further understood that in some of the embodiments illustrated in FIGS. 4A-4D the bottom or lower edge 52A of the panel(s) 50A, 50B may alternatively terminate at or adjacent to the lowest support rail mounted thereto.

Figure 8:
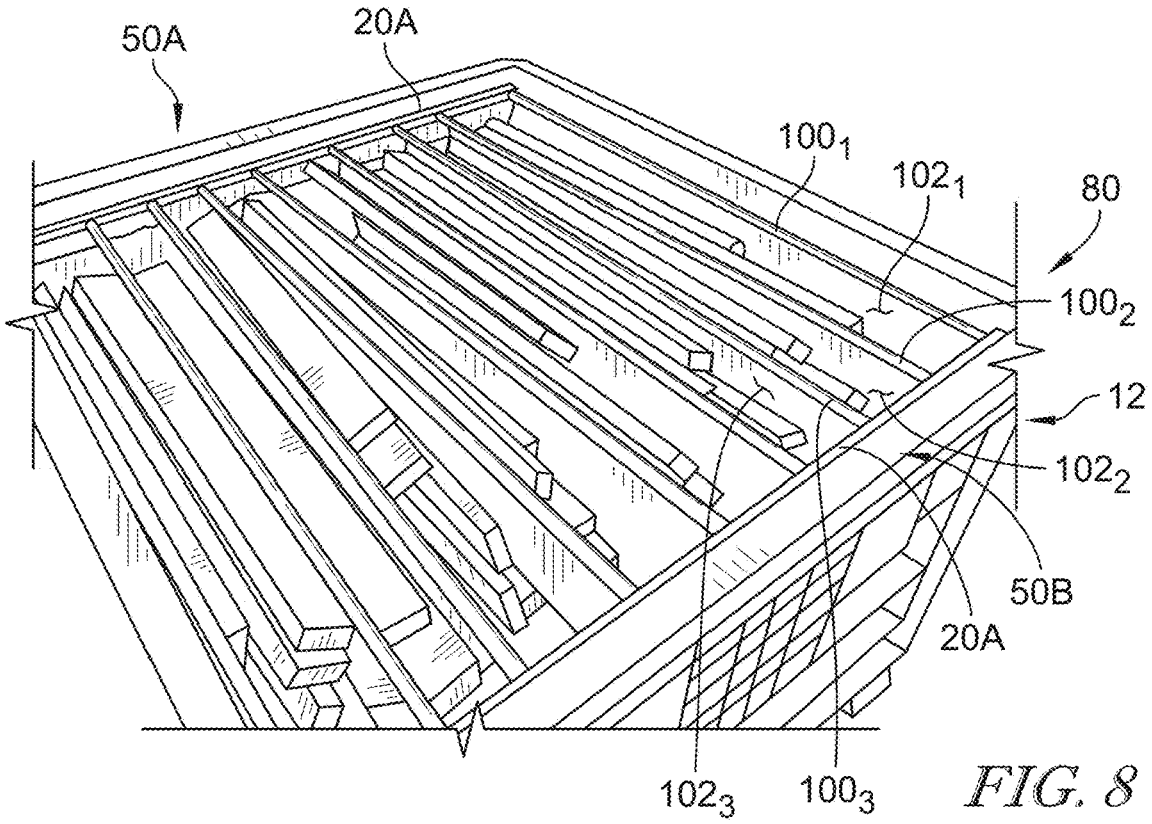
FIG. 8 is still another perspective view of the example of FIG. 4C showing a plurality of sliding dunnage support rods, with cargo-carrying dunnage pouches mounted thereto, slidingly received in the top dunnage support rails.

Additional views of the dunnage support assembly 80 of FIG. 4C are illustrated by example in FIGS. 6, 7A-7B and 8. In FIG. 8, the example dunnage support assembly 80 is shown supporting a plurality of sliding dunnage pouches. In particular, opposite ends of each of a plurality of rigid, elongated dunnage rods, e.g., $\mathbf{100}_1$, $\mathbf{100}_2$, $\mathbf{100}_3$, etc. are operatively received within respective channels of the opposed top-tier dunnage support rails 20A. The support rails 20A and the ends of the dunnage rods $\mathbf{100}_1$, $\mathbf{100}_2$, $\mathbf{100}_3$, etc. are illustratively configured in a conventional manner such that the rods $\mathbf{100}_1$, $\mathbf{100}_2$, $\mathbf{100}_3$, etc. are slidable or rollable along and relative to the rails 20A. Opposite ends of conventional flexible or semi-flexible dunnage pouches, e.g., $\mathbf{102}_1$, $\mathbf{102}_2$, $\mathbf{102}_3$, etc. are affixed to and along the rods $\mathbf{100}_1$, $\mathbf{100}_2$, $\mathbf{100}_3$, etc. in a conventional manner such that cargo can be stored/carried within each pouch $\mathbf{102}_1$, $\mathbf{102}_2$, $\mathbf{102}_3$, etc. and such that individual cargo components can be accessed from the pouches $\mathbf{102}_1$, $\mathbf{102}_2$, $\mathbf{102}_3$, etc. by sliding the rods $\mathbf{100}_1$, $\mathbf{100}_2$, $\mathbf{100}_3$, etc. along and relative to the rails 20A.

Referring now to FIG. 5, a side view is shown of one of the panels 50A of the dunnage support assembly 80 illustrated in FIGS. 4C and 6-8. As described above, the ends of the illustrated dunnage rods 100A, 100B, 100C and the respective support rails 20A, 20B, 20C are configured such that the ends of the rods 100A, 100B, 100C are slidable along and relative to the respective rails 20A, 20B, 20C. In the embodiment illustrated in FIG. 5, the ends of the rods 100A, 100B, 100C define retention elements 101A, 101B, 101C, and the rails 20A, 20B, 20C define longitudinal channels 21A, 21B, 21C therein sized and configured to receive and retain the retention elements 101A, 101B, 101C therein while allowing the rods 100A, 100B, 100C to slide along the rails 20A, 20B, 20C. In some embodiments, the retention elements 101A, 101B, 101C are configured to slide relative to and along the channels 21A, 21B, 21C, although in alternate embodiments the retention elements 101A, 101B, 101C may be configured to rotate relative to the rods 100A, 100B, 100C so as to roll along the channels 21A, 21B, 21C. It will be understood, however, that the illustrated configuration of the rods 100A, 100B, 100C and of the rails 20A, 20B, 20C is provided only by way of example, and that one or more of the rods 100A, 100B, 100C and rails 20A, 20B, 20C may be configured differently than that shown while still maintaining the described function. In some alternate embodiments, one or more of the rods 100A, 100B, 100C may be flexible or semi-flexible or omitted entirely, and in such embodiments the corresponding pouch(es) 102 may be so-called hammock-style pouches supported primarily at opposite ends by sliding coupling to the opposed dunnage support rail(s) 20.

As also illustrated in FIG. 5, the width of the channel 54 defined between the inner surfaces of the flanges 52E, 52F and of the rear face 52H is illustratively sized to accommodate a width of the side wall of the transportation and/or storage container 12. In some embodiments, as illustrated by dashed-line representation in FIG. 5, the width of the channel 54 is only slightly larger than that of the side wall of the container 12 such that the width of the side wall of the container 12 substantially fills the channel 54. In applications in which the width of the side wall of the container 12 is less than that of the channel 54, an auxiliary panel 13 may be positioned between the inner surface of the side wall of the container 12 and the inner face 52H of the panel 50A, as also illustrated by example in FIG. 5, to take up at least some of the gap between the width of the channel 54 and the lesser width of the side wall of the container 12. In any case, as the panel 50A shown in FIG. 5 further illustrates, the panels 50A, 50B of the dunnage support assembly 80 are slidingly received on the respective side walls of the container 12, and the weight of the dunnage support assembly 80, including cargo carried therein, is supported on the top edges 12A of the side walls and thus by the entire structures of the side walls.

In some embodiments, the panels 50A, 50B may be coupled to the side walls of the container 12. In some applications for example, one or more through-holes 55 may be provided in the flange 52E (and/or the flange 52F), and one or more conventional fixation members 57, e.g., one or more screws or bolts or the like, may be passed through the through-hole(s) to secure the panels 50A, 50B to the side walls of the container 12 as illustrated be example in FIG. 3A. In other embodiments, no such through-holes may be provided, and the flanges 52E instead rest on the top edges 12A of the side walls of the container 12. In still other embodiments, one or more brackets may be affixed to and between the panels 50A, 50B and the side walls or floor of the container 12. In still other embodiments, one or more clips or pins may be used to secure the panels 50A, 50B to the side walls or floor of the container 12.

Figure 9A:
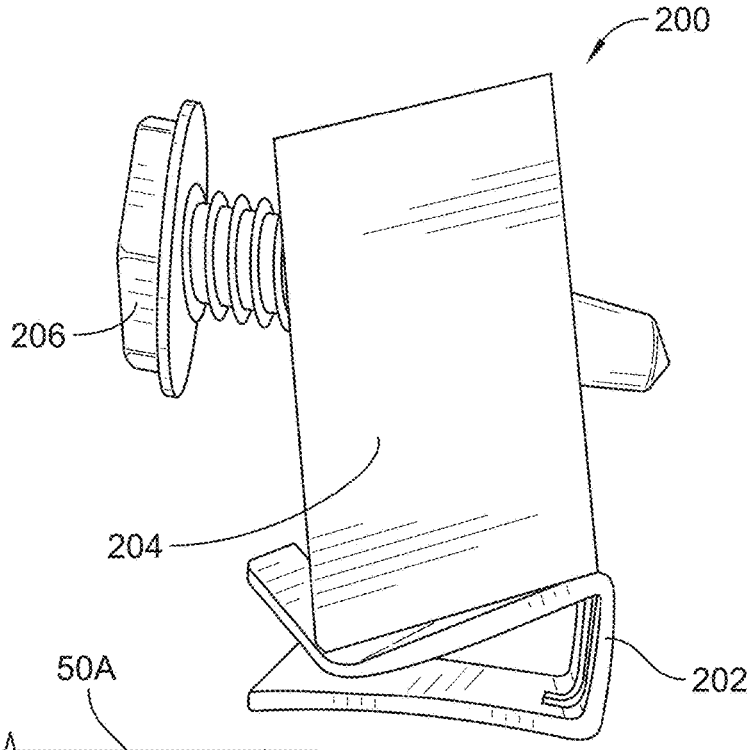
FIG. 9A is a side elevational view of an embodiment of a retaining clip for pinning at least one side of a rail support panel to a side wall of a transportation and/or storage container.
Figure 9B:
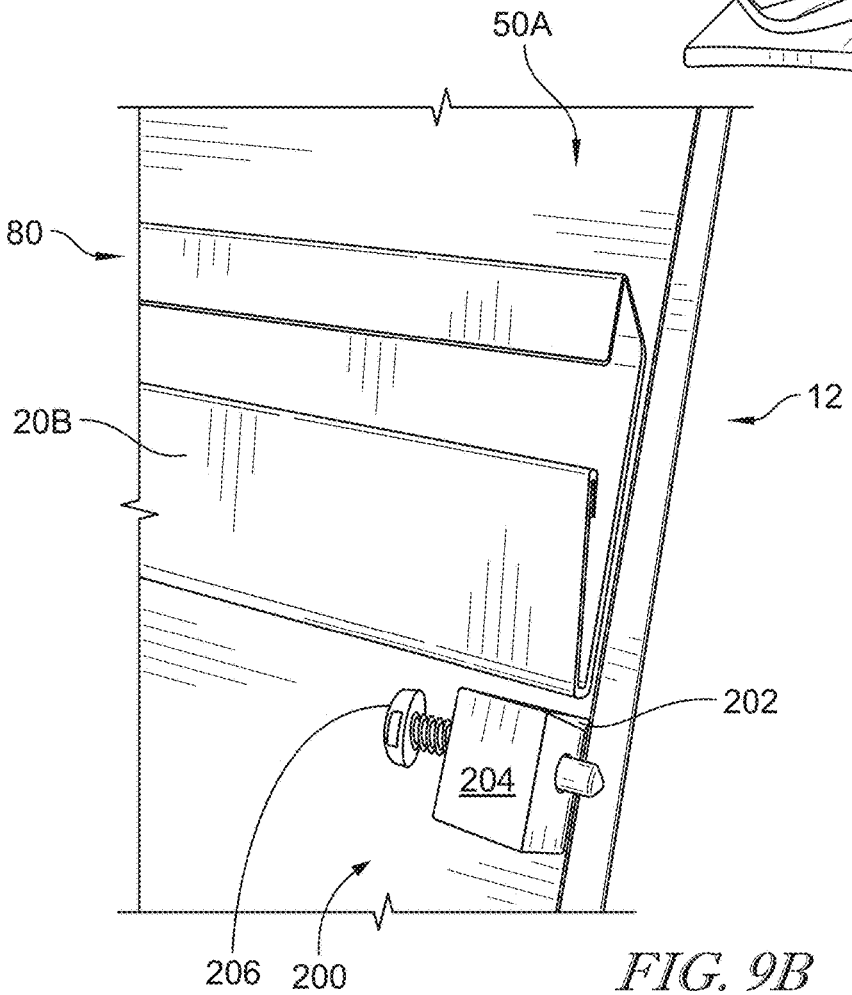
FIG. 9B is a perspective view of the retaining clip of FIG. 9A mounted to a side edge of a rail support panel.
Figure 9C:
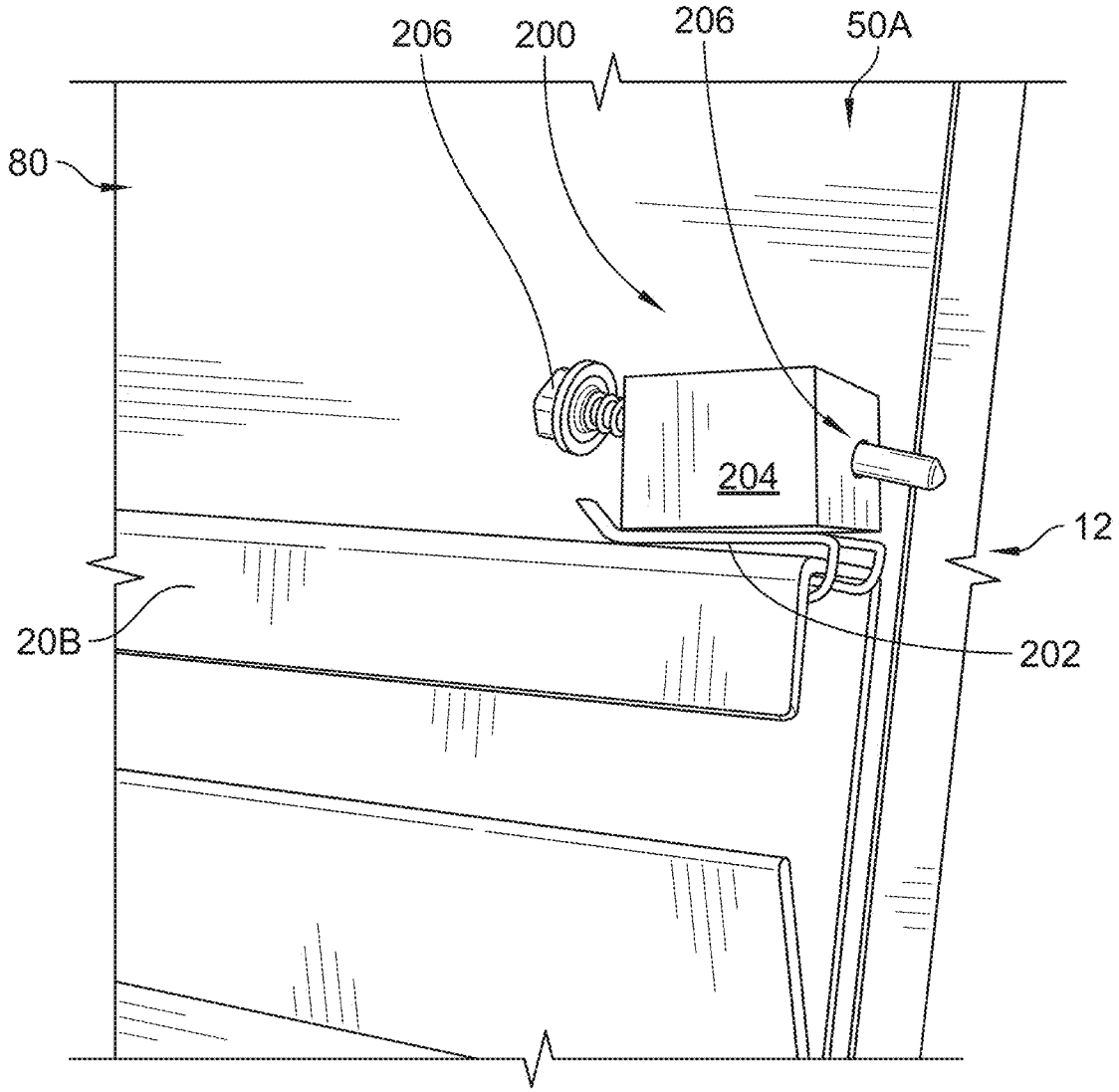
FIG. 9C is a perspective view of the retaining clip of FIG. 9A mounted to a side edge of a dunnage support rail that is mounted to a rail support panel.

Referring now to FIGS. 9A-9C, an example embodiment of a retaining clip 200 is shown for securing the panels 50A, 50B to the side walls of the container 12. In the illustrated embodiment, the retaining clip 200 includes a conventional spring clip 202, e.g., a conventional U-shaped spring clip, coupled to a carrier 204 through which a screw 206 is threaded. The spring clip 202 may be clipped to a side of the panel 50A (and/or 50B) as illustrated by example in FIG. 9B, or may be clipped to a top (or bottom) of one or more of the support rails, e.g., 20B, as illustrated by example in FIG. 9C. With the panels 50A, 50B received within a container 12, the screw(s) 206 is/are advanced through the carrier(s) 204 into engagement with a respective side wall of the container 12 to secure the panel 50A (and/or 50B) to the container 12. In FIGS. 9B and 9C, it will be understood that the respective side wall of the container 12 into which the screw(s) 206 is/are advanced is omitted for clarity of illustration of the various components of the clip 200.

Figure 10A:
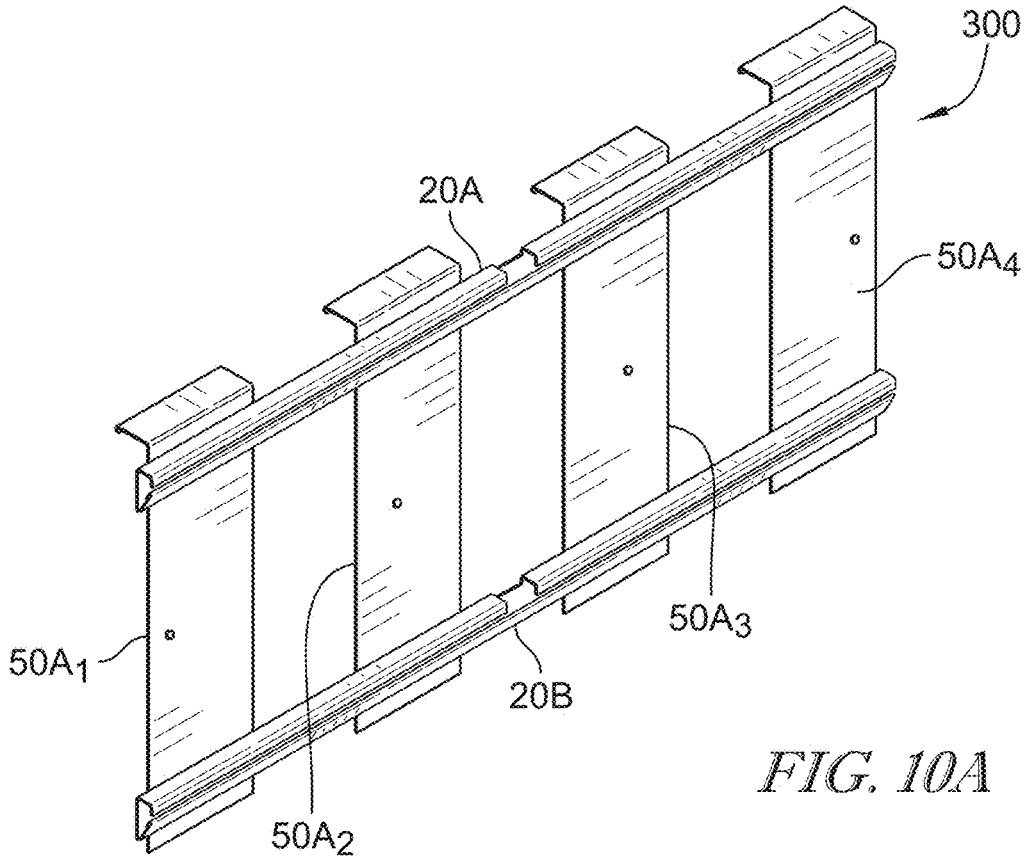
FIG. 10A is a perspective view of another embodiment of a rail support system for a transportation and/or storage container in the form of a multi-piece rail support panel to which two dunnage support rails are mounted.

Referring now to FIG. 10A, an alternate embodiment of a dunnage support assembly 300 is shown. In the illustrated embodiment, the assembly 300 is similar in many respects to the assembly 50 illustrated in FIG. 3A. The assembly 300 differs from the assembly 50 in that the panel 50A is provided in the form of a plurality of vertically-disposed and horizontally spaced apart panel strips each defining a flange at the top thereof as described with respect to FIG. 3A. In the example embodiment illustrated in FIG. 10A, four such panel strips $\mathbf{50A}_1$-$\mathbf{50A}_4$ are shown joined to one another via two horizontally-disposed support rails 20A, 20B; one rail 20A adjacent to the tops of the panel strips $\mathbf{50A}_1$-$\mathbf{50A}_4$ and another rail 20B adjacent to the bottoms of the panel strips $50A_1$-$50A_4$. It will be understood, however, that the embodiment illustrated in FIG. 10A is provided only by way of example, and that the assembly 300 may include more or fewer panel strips. In other alternate embodiments, one or more of the flanges may be omitted from one or more of the panel strips. In still other embodiments, more or fewer support rails may be secured to the panel strips. In any case, two assemblies 300 are mounted to the container 12; one on each of two opposed container side walls, as described above.

Figure 10B:
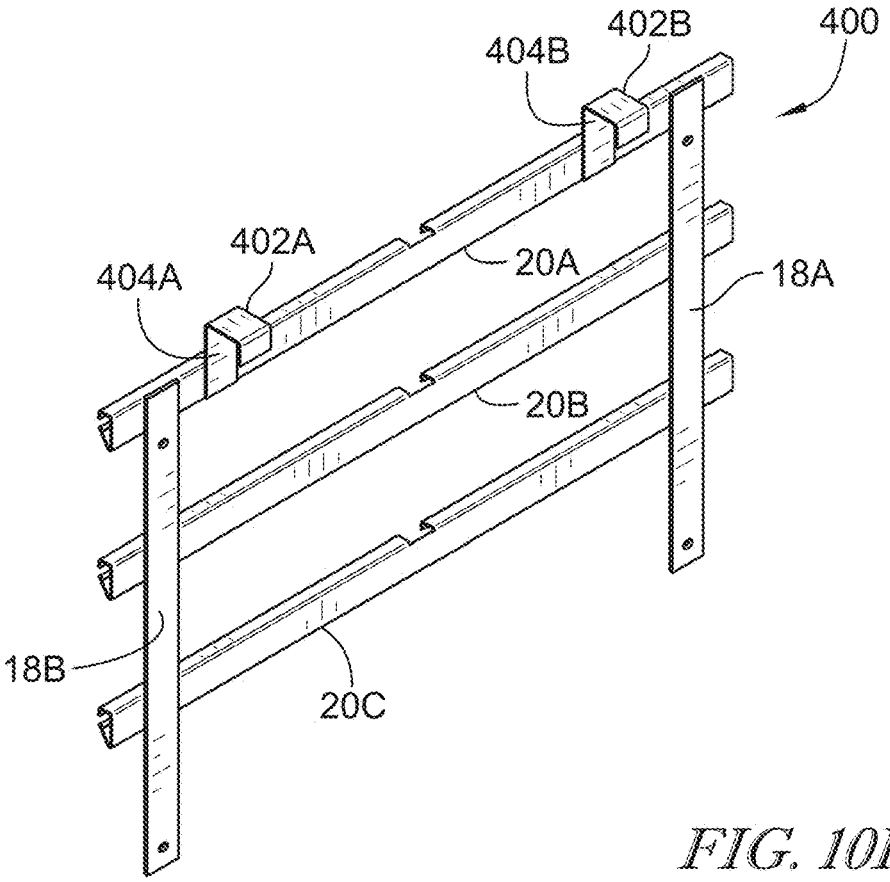
FIG. 10B is a perspective view of yet another embodiment of a rail support system for a transportation and/or storage container in the form of a dunnage support frame of the type illustrated in FIG. 2A to which two brackets are mounted and configured to couple to a side wall of a transportation and/or storage container similarly to the embodiment illustrated in FIG. 10A.

Referring now to FIG. 10B, another alternate embodiment of a dunnage support assembly 400 is shown. In the illustrated embodiment, the assembly 400 is similar in many respects to the assembly 14 illustrated in FIGS. 1-2B. The assembly 400 differs from the assembly 14 in that the corner frame components 22A-22D are omitted, and two or more spaced-apart brackets are secured to the top support rail 20A. Although two such brackets 402A, 402B shown in FIG. 10B, it will be understood that the assembly 40 may include more than two brackets. In any case, the brackets 402A, 402B are illustratively configured similarly to the flanges 50E, 50F of the panels 50A, 50B described above in that the brackets 402A, 402B illustratively each define a respective channel 404A, 404B sized and configured to be received by and on a side wall of the container 12 similarly as described above with respect to the panels 50A, 50B. In this embodiment, assembly 400 is substantially identical to the frames 14A, 14B illustrated in FIG. 2A with the exception of the brackets 402A, 402B. Unlike the frames 14A, 14B, however, the assembly 400 is configured to be received on and supported by the top edge 12A of a container side wall 12 as described above, and not bolted or otherwise secured to or through the side walls as described in the background section. It will be understood, however, that the embodiment illustrated in FIG. 10B is provided only by way of example, and that the assembly 400 may include more or fewer frame members 18A, 18B. In other alternate embodiments, more or fewer support rails may be secured to the frame members 18A, 18B. In some alternate embodiments, the brackets 402A, 402B may alternatively be secured to the respective frame members 18A, 18B. In other alternate embodiments, the brackets 402A, 402B may be integral with the respective frame members 18A, 18B, i.e., such that the frame member 18A and the bracket 402A together form a unitary member and such that the frame member 18B and the bracket 402B likewise together form a unitary member. In any case, two assemblies 400 are mounted to the container 12; one on each of two opposed container side walls, as described above.

In any of the embodiments illustrated in the attached figures and described above, the panels 50A, 50B or panel strips, as well as the one or more support rails 20A, 20B, etc., such components are illustratively formed of steel or other metal composite. In alternate embodiments, lighter-weight materials, e.g., one or more rigid plastic material(s), may be used for at least the panels 50A, 50B (or panel strips) and, in some cases, the support rails.

Figure 2A:
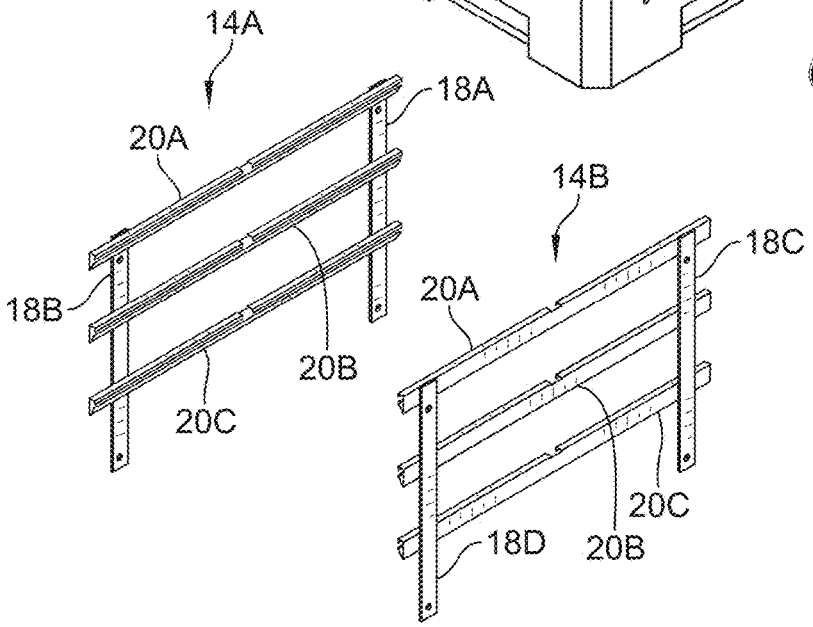
FIG. 2A (PRIOR ART)
FIG. 2A is a perspective view of a pair of dunnage support frames of the conventional dunnage support assembly mounted in the dunnage container of FIG. 1.
Figure 2B:
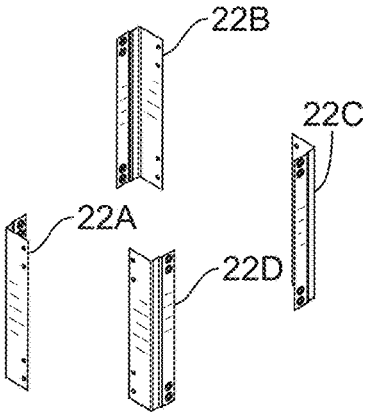
FIG. 2B (PRIOR ART)
FIG. 2B is a perspective view of four corner components of the conventional dunnage support assembly mounted in the dunnage container of FIG. 1.

It should be apparent from the foregoing that the various dunnage support assemblies described with respect to FIGS. 3A-10B provide a number of advantages over the assembly illustrated in FIGS. 1-2B. For example, the assemblies of FIGS. 3A-10B are supported on and by the top edges 12A of the side walls of the container 12 rather than via through-holes provide through the side walls of the container 12. The assemblies of FIGS. 3A-10B therefore enjoy stronger support and mounting of the assemblies of FIGS. 3A-10B than that of FIGS. 1-2B. Moreover, unlike the assembly of FIGS. 1-2B, the assemblies of FIGS. 3A-10B do not depend on the configuration of the outer surfaces of the container sides. Further still, since the assemblies of FIGS. 3A-10B are typically only pinned or clipped to the container 12, transferring the assemblies of FIGS. 3A-10B to a different container can be accomplished via a conventional lift truck or other such device without disassembling the dunnage support assemblies or unloading cargo therefrom. It will be understood that any of the assemblies of FIGS. 3A-10B may be used to support dunnage pouches secured to rigid support poles, e.g., as illustrated in FIG. 5, and/or to support hammock-style dunnage pouches.

Figure 11A:
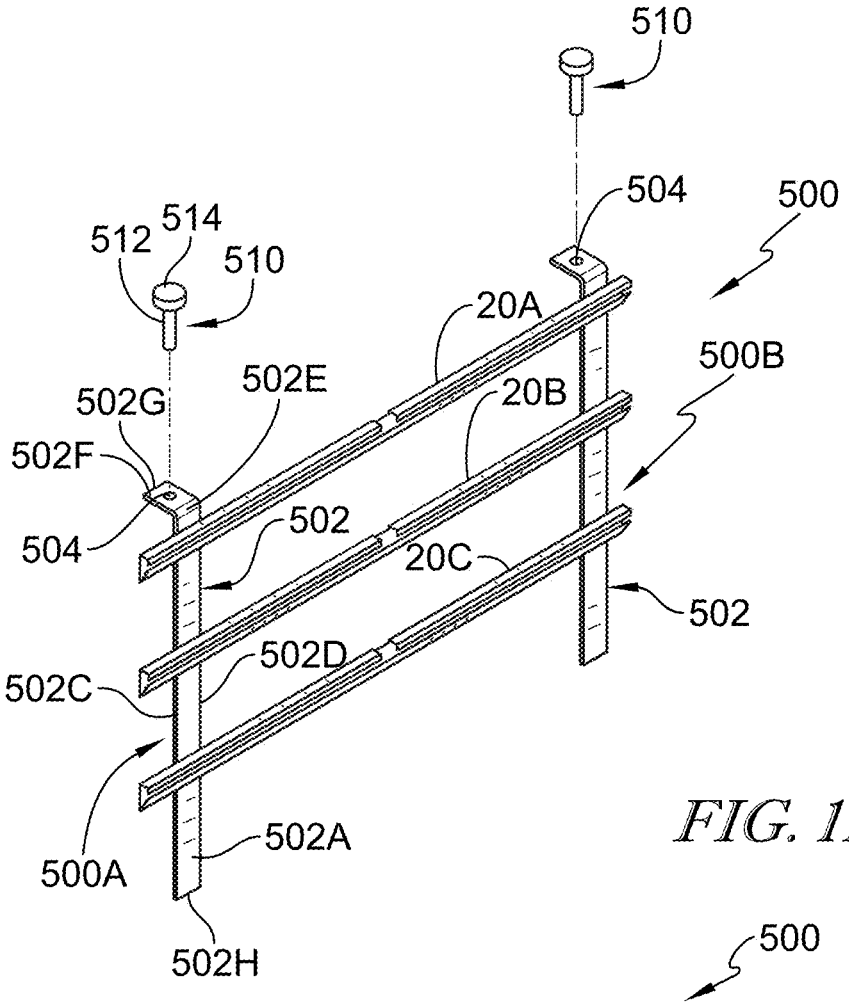
FIGS. 11A and 11B are respective front and rear perspective views of yet another embodiment of a rail support system for a transportation and/or storage container in the form of a flanged, multi-piece rail support panel to which three dunnage support rails are mounted.
Figure 11B:
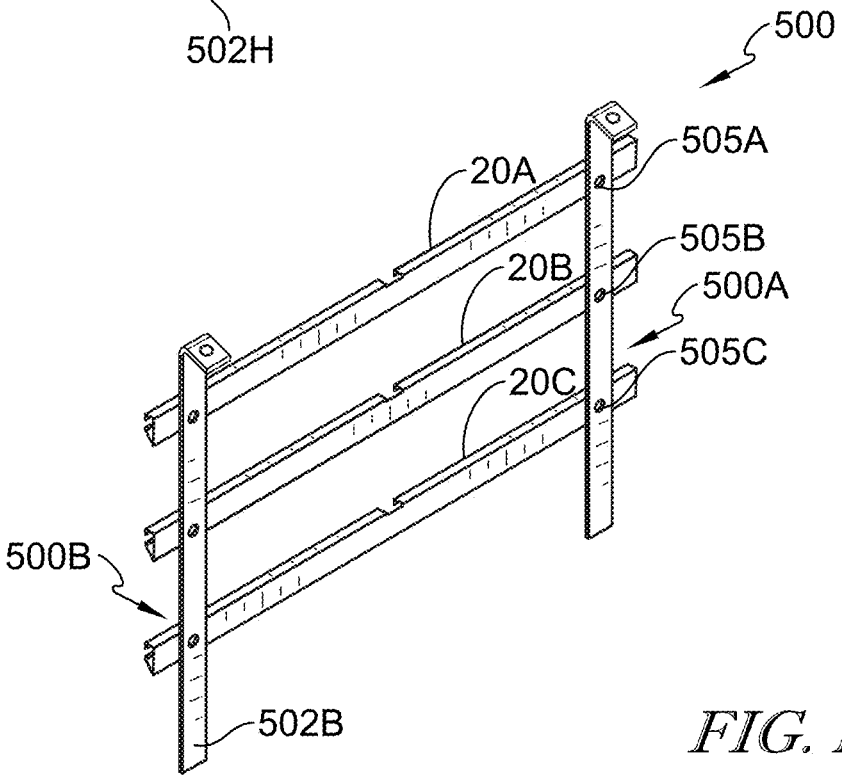

Referring now to FIGS. 11A and 11B, another alternate embodiment of a rail support assembly 500 is shown. In the illustrated embodiment, the assembly 500 is similar in many respects to the assembly 300 illustrated in FIG. 10A. The assembly 500 differs from the assembly 300 in that the vertically-disposed and horizontally spaced apart panel strips each defining a single flange at the top thereof, so as to define a single-ended channel between the flange and the adjacent body of the panel strip as described above. As depicted by example in FIG. 11A, the assembly 500 includes two such panel strips 500A, 500B each positioned at or near opposite ends of three horizontally spaced apart support rails 20A, 20B, 20C, wherein the support rails 20A, 20B, 20C are as described above. It will be understood that whereas the rail support assembly 500 illustrated in FIGS. 11A and 11B include only two such panel strips 500A, 500B, the assembly 500 in alternate embodiments may include more than two horizontally spaced apart panel strips, or may be provided in the form of a single panel as depicted by example in FIGS. 3A and 4A-4D. In any case, each panel strip 500A, 500B (or the single panel) includes an elongated body 502 having a front face 502A and an opposite a rear face 502B, each terminating at opposite side edges 502C, 502D and each also terminating at opposite top and bottom edges 502E, 502H respectively. Integral with, or attached to, the top edge 502E is a planar flange 502F which extends rearwardly away from the front face 502A to a terminal edge 502G, and which illustratively extends the width of the strip body 502, or at least a portion thereof, between the side edges 502C, 502D. The length of the body 502 between the top and bottom edges 502E, 502H may be as described above with respect to the panels 50A, 50B. The downwardly-facing surface of the flange 502F and the inner surface 502B of the body 502 adjacent to the flange 502F form an angle therebetween. As the flange 502F of the support strips 500A, 500B will support the assembly 500 on a side wall of a transportation or storage container as described above, the angle formed between the flange 502F and the body 502 of the panel strips 500A, 500B will depend on the profile(s) of the top edge and the walls of the container side walls. In embodiments in which the walls and the top edges of the container side walls are planar, for example, the angle between the flange 502F and the body 502 of the panel strips 500A, 500B (or of a single panel) will be approximately 90 degrees. In other embodiments, the angle between the flange 502F and the body 502 of the panel strips 500A, 500B (or of a single panel) may be greater or less than 90 degrees (or non-linear) to correspond to the respective profile of the walls and/or top edges of the container side walls.

The panel strips 500A, 500B are illustratively configured, e.g., by providing appropriate through-holes, to support one or more horizontally-disposed dunnage support rails thereon to complete a dunnage support assembly. In the example illustrated in FIGS. 11A and 11B, three such rails 20A, 20B, 20C are shown, and in this embodiment three horizontally spaced apart holes, e.g. through-holes, 505A, 505B, 505C are defined on or through the bodies 502 of the panel strips 500A, 500B. In alternate embodiments, more or fewer support rails may be mounted to the panel strips 500A, 500B. In some embodiments, the number and position(s) of the support rail mounting holes, e.g., 505A, 505B, 505C, on and along the bodies 502 of the panel strips 500A, 500B may match the number of support rails to be mounted thereto. In alternate embodiments, each of the panel strips 500A, 500B may be provided with the maximum (or fewer) number of support rail mounting holes for a given length of panel strip bodies 502, so that a single version of the panel strips 500A, 500B may be provided for any possible number and configuration of support rails, as illustrated by example in FIGS. 4A-4B.

Figure 13:
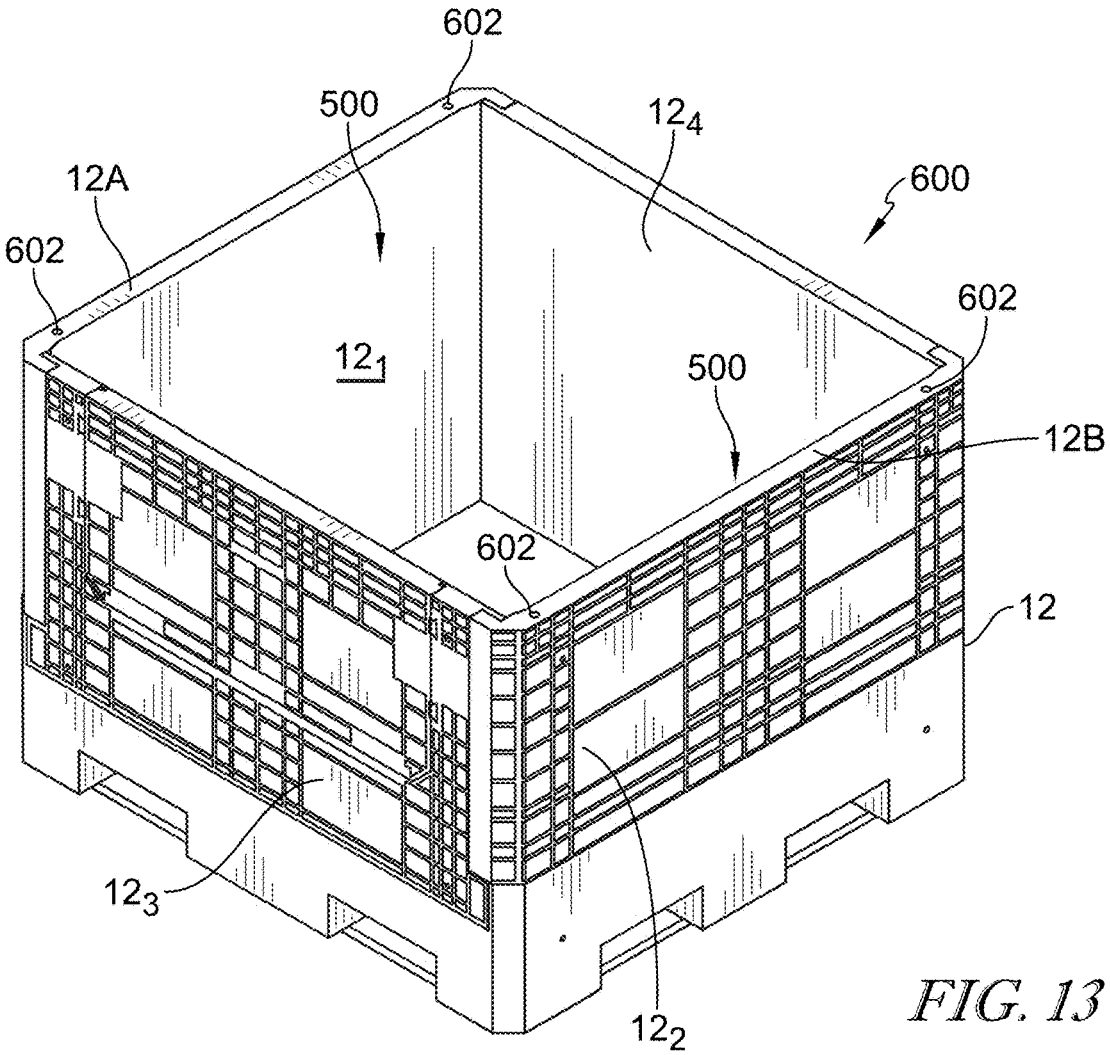
FIG. 13 is a perspective view of a dunnage container configured to receive and be coupled to the rail support system of FIGS. 11A-11B.
Figure 14:
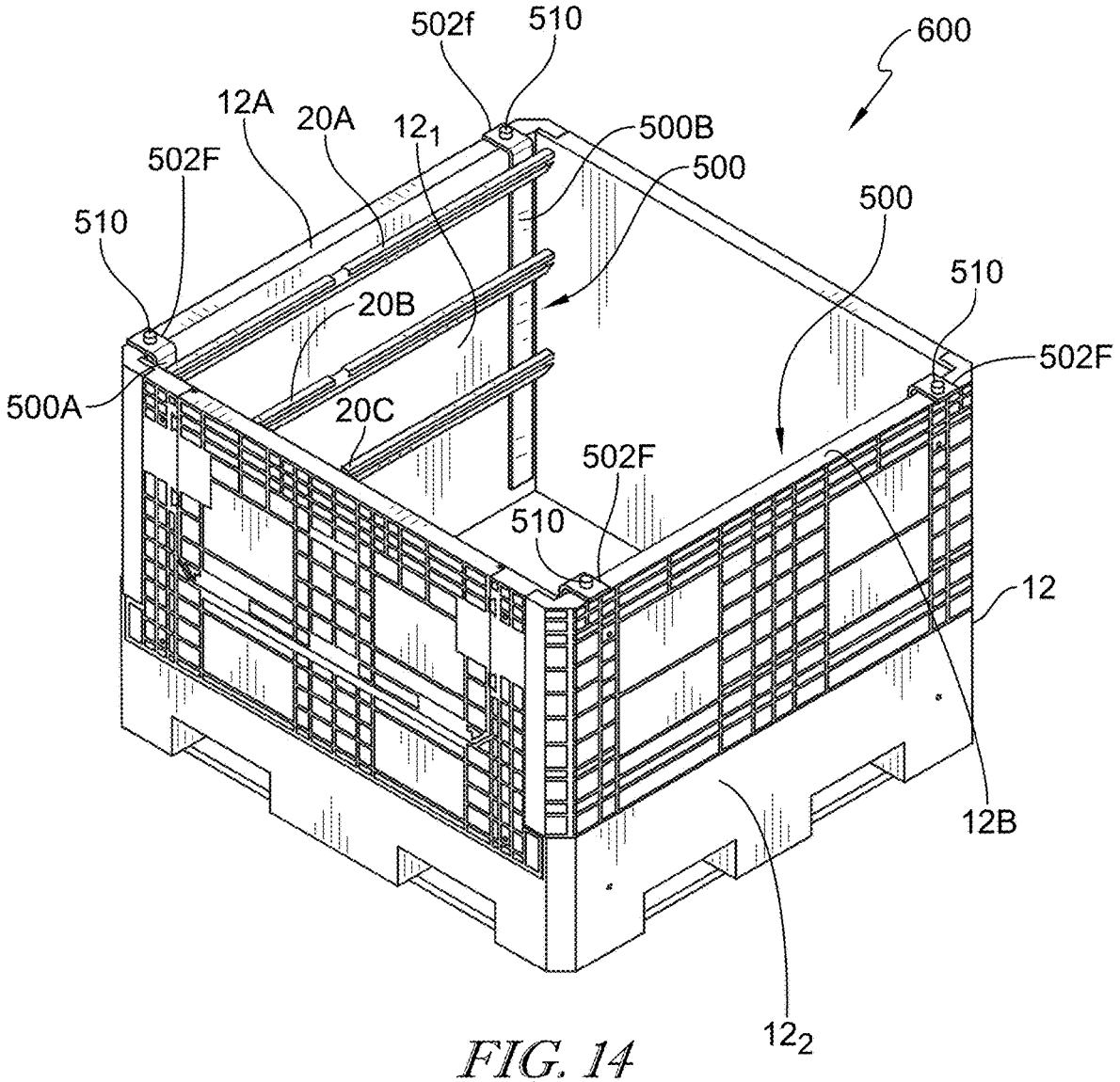
FIG. 14 is a perspective view of the rails support system of FIGS. 11A-11B received within and coupled to the dunnage container of FIG. 13.

In the embodiment illustrated in FIGS. 11A and 11B, elongated securement members are provided to secure the flanges 502F of the rail support assembly 500 to the side wall of a transportation or storage container 12. In some embodiments, elongated securement members 510 may be separate from the panel strips 500A, 500B, as depicted by example in FIG. 11A, and in other embodiments elongated securement members 510' may be attached to or integral with the flanges 502F of the panel strips 500A, 500B as depicted by example in FIG. 12. In either case, the elongated securement members 510, 510' are positioned so as to align with holes and bores or passageways defined through the side walls of the container 12 along opposed top edges thereof. An example is depicted in FIG. 13 in which a transportation or storage container 12 is shown having four side walls 121-124, in which the side walls 121 and 122 are opposite one another, and in which the side wall 121 has a to edge 12A and the side wall 122 has a top edge 12B. In this example, two openings/passageways 602 are formed into the top edge 12A of the side wall 121 at or near opposite ends of the side wall 121, and two openings/passageways 602 are likewise formed into the top edge 12B of the side wall 122 at or near opposite ends of the side wall 122. In this example, the dunnage support assemblies 500 of FIGS. 11A and 11B will include two corresponding, and correspondingly positioned, elongated securement members 510 and/or 510', regardless of the number of panel strips used for each assembly 500. In alternate embodiments, the dunnage container 12 and the rail support assemblies may configured to include more or fewer openings/passageways 602 and elongated securement members 510 and/or 510' in more or fewer panel strips. In any case, the openings/passageways 602 and the elongated securement members 510 and/or 510' are configured such that the number of elongated securement members 510 and/or 510' will align with a corresponding number of openings/passageways 602 so that the elongated securement members 510 and/or 510' will be received within the respective openings 602 to couple and secure the flanges 502F, and thus the respective rail support assemblies 500, to the respective side walls 121, 122 of the container 12, as depicted symbolically in FIG. 13 and assembled in FIG. 14.

Referring again to FIG. 11A, an embodiment is shown of an elongated securement member 510 separate from the panel strips 500A, 500B. The elongated securement member 510 illustratively includes a shaft portion 512 coupled to, or integral with, a head portion 514 at one end thereof. In embodiments employing such elongated securement members 510, each panel strip 500A, 500B to be coupled to a side wall of a storage container 12 by an elongated securement member 510 defines an opening or passageway 504 through the flange 502F. The openings 504 and the elongated securement members 510 are illustratively sized such that the shaft portion 512 of the elongated securement member 510 may pass through the openings 504, but the head portion 514 is prevented from passing through the openings 504. In such embodiments, the openings/passageways 602 defined along the top edges 12A, 12B of the side walls $12_1$, $12_2$ of the container 12, as well as the positions of the panel strips 500A, 500B relative to the side walls $12_1$, $12_2$, are configured such that the openings 504 defined through the flanges 502F of the panel strips 500A, 500B align with the openings/passageways 602 defined in the side walls $12_1$, $12_2$ of the container 12 when each rail support assembly 500 is lowered into the container 12 adjacent to a respective wall $12_1$, $12_2$ of the container 12 as depicted symbolically in FIG. 13. With the openings 504 and the openings/passageways 602 so aligned, an elongated securement member 510 is then inserted into each aligned pair of openings 504/602 to couple the respective flange 502F, and thus both rail support assemblies 500, to the container to form the resulting dunnage support assembly 600 depicted by example in FIGS. 13 and 14. In some embodiments, the openings 504 defined through the flanges 502F may be countersunk, and the head portions 514 of the elongated securement members 510 may be correspondingly configured, such that when the elongated securement members 510 are received within the openings 504 and extend down into the openings/passageways 602 of the container 12, the top surfaces of the head portions 514 are co-planar with, or recessed relative to, respective planes formed by the top surfaces of the respective flanges 502F.

Figure 12:
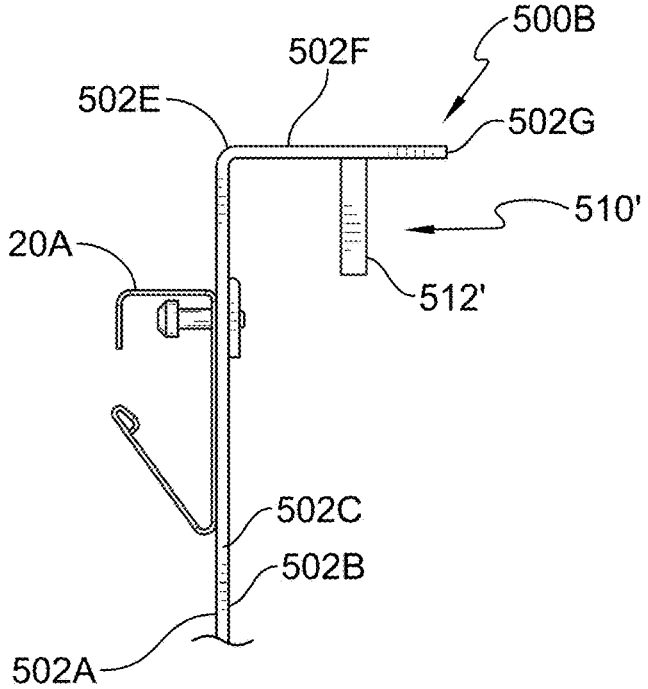
FIG. 12 is a magnified side view of a portion of the rail support system of FIG. 11B.

Referring now to FIG. 12, an embodiment is shown of an elongated securement member 510' attached to, or integral with, the flanges 502F of the panel strips 500A, 500B. In the illustrated embodiment, the elongated securement member 510' illustratively includes a pin or shaft portion 512' affixed to (e.g., by welding or other conventional technique), or integral with, a the underside of the flange 502F, such that the pin 512' extends downwardly away from the downwardly-facing inner or underside wall of the flange 502F. In some alternate embodiments, the elongated securement member 510, received within the opening 504 formed through the flange 502F, may be welded or otherwise affixed to the flange 502F to achieve the same feature of the elongated securement members being affixed to the flanges 502F of the panel strips 500A, 500B. In any case, the openings/passageways 602 are illustratively configured and positioned as described above, such that as the rail support assemblies 500A, 500B are lowered into the container adjacent to the respective side walls $12_1$, $12_2$, as illustrated symbolically in FIG. 13, the pins 512' (or the fixed-position shaft portions 512 of the elongated securement members 510) pass into the respective openings/passageways 602 to couple the rail support assemblies 500A, 500B to the respective side walls $12_1$, $12_2$ to form the resulting dunnage support assembly 600 depicted by example in FIGS. 13 and 14. With the rail support assemblies 500A, 500B so coupled to the side walls $12_1$, $12_2$ of the container 12, dunnage pouches may be operatively coupled to and between respective pairs of support rails so as to be slidable relative to and therealong as described above.

While the disclosure has been illustrated and described in detail in the drawings and foregoing description, such an illustration and description is to be considered as exemplary and not restrictive in character, it being understood that only illustrative embodiments have been shown and described and that all changes and modifications consistent with the disclosure and recited claims are desired to be protected.

What is claimed is:

1. A dunnage support assembly for a transportation or storage container, comprising:

a first panel defining a first flange at a top end thereof, the first flange running at least partially along a length of the first panel, the first panel configured to be received within a transportation or storage container with the first flange received on a top edge of one side wall thereof such that the first panel is supported by the first flange on and by the one side wall, a first plurality of elongated securement members affixed to, or configured to extend through, the first flange, such that each of the first plurality of elongated securement members is positioned along the first flange so as to extend into a corresponding one of a plurality of openings formed in the top edge of the one side wall as the first flange is received on the top edge of the one side wall, a second panel defining a second flange at a top end thereof, the second flange running at least partially along a length of the second panel, the second panel configured to be received within the transportation or storage container with the second flange received on a top edge of another side wall, opposite the one side wall, such that the second panel is supported by the second flange on and by the another side wall, a second plurality of elongated securement members affixed to, or configured to extend through, the second flange, such that each of the second plurality of elongated securement members is positioned along the second flange so as to extend into a corresponding one of a plurality of openings formed in the top edge of the another side wall as the second flange is received on the top edge of the another side wall, one or more first elongated support rails secured to the first panel and oriented to be substantially parallel with the top edge of the one side wall, and one or more second elongated support rails secured to the second panel and oriented to be substantially parallel with the top edge of the another sidewall, wherein opposing pairs of the one or more first and second elongated support rails are configured to support a respective plurality of dunnage pouches therebetween and slidable relative thereto.

2. The dunnage support assembly of claim 1, wherein the first panel comprises at least two spaced apart panel strips each defining a separate first flange at a top end thereof, the at least two panel strips of the first panel secured together by the one or more first elongated support rails.

3. The dunnage support assembly of claim 2, wherein the second panel comprises at least two spaced apart panel strips each defining a separate second flange at a top end thereof, the at least two panel strips of the second panel secured together by the one or more second elongated support rails.

4. The dunnage support assembly of claim 1, wherein a downwardly-facing surface of the first flange and an adjacent inner surface of the first panel together define an single-sided channel configured to be received on the one side wall with the first flange supported on the top edge of the one side wall and with the inner surface of the first panel received against an inner surface of the one side wall facing an interior of the container.

5. The dunnage support assembly of claim 4, wherein a downwardly-facing surface of the second flange and an adjacent inner surface of the second panel together define a single-sided channel configured to be received on the another side wall with the second flange supported on the top edge of the another side wall and with the inner surface of the second panel received against an inner surface of the another side wall facing the interior of the container.

6. The dunnage support assembly of claim 1, wherein the first plurality of elongated securement members each comprise an elongated pin affixed to the first flange so as to extend downwardly away from a downwardly-facing surface of the first flange.

7. The dunnage support assembly of claim 6, wherein the second plurality of elongated securement members each comprise an elongated pin affixed to the second flange so as to extend downwardly away from downwardly-facing surface of the second flange.

8. The dunnage support assembly of claim 7, wherein the first plurality of elongated securement members include at least a first elongated pin affixed to the first flange at or near one end of the first flange, and at least a second elongated pin affixed to the first flange at or near an opposite end of the first flange, and wherein the second plurality of elongated securement members include at least a third elongated pin affixed to the second flange at or near one end of the second flange, and at least a fourth elongated pin affixed to the second flange at or near an opposite end of the second flange.

9. The dunnage support assembly of claim 1, wherein the first flange defines therethrough at least two openings spaced apart from one another along the first flange, and wherein the first plurality of elongated securement members each comprise a shaft portion sized to be received through one of the at least two openings defined through the first flange, and a head portion sized larger than the at least two openings defined through the first flange such that, with the shaft portion of each of the first plurality of elongated securement members extending through a respective one of the at least two openings defined through the first flange, the corresponding head portion is prevented from passing through the respective one of the at least two openings defined through the first flange.

10. The dunnage support assembly of claim 9, wherein each of the at least two openings defined through the first flange is countersunk such that, with the shaft portion of each of the first plurality of elongated securement members extending through a respective one of the at least two openings defined through the first flange and the corresponding head portion is supported against the first flange, a top surface of each head portion is co-planar with, or extends below, a plane defined by a top surface of the first flange.

11. The dunnage support assembly of claim 9, wherein the second flange defines therethrough at least two openings spaced apart from one another along the second flange, and wherein the second plurality of elongated securement members each comprise a shaft portion sized to be received through one of the at least two openings defined through the second flange, and a head portion sized larger than the at least two openings defined through the second flange such that, with the shaft portion of each of the second plurality of elongated securement members extending through a respective one of the at least two openings defined through the second flange, the corresponding head portion is prevented from passing through the respective one of the at least two openings defined through the second flange.

12. The dunnage support assembly of claim 11, wherein each of the at least two openings defined through the second flange is countersunk such that, with the shaft portion of each of the second plurality of elongated securement members extending through a respective one of the at least two openings defined through the second flange and the corresponding head portion supported against the second flange, a top surface of each head portion is co-planar with, or extends below, a plane defined by a top surface of the second flange.

13. The dunnage support assembly of claim 11, wherein the at least two openings spaced defined through first flange include a first opening at or near one end of the first flange and a second opening at or near an opposite end of the first flange, and wherein the at least two openings spaced defined through second flange include a third opening at or near one end of the second flange and a fourth opening at or near an opposite end of the second flange.

14. A dunnage support assembly for a transportation or storage container, comprising:

a first assembly including:

first and second elongated support strips spaced apart from one another, the first elongated support strip defining a first flange at a top end thereof and the second elongated strip defining a second flange at a top end thereof, one or more first elongated support rails secured transversely to and between the first and second support strips, the first assembly configured to be received within a transportation or storage container with the first and second flanges received on a top edge of one side wall thereof such that the first assembly is supported by the first and second flanges on and by the one side wall, and means for coupling the first and second flanges to the one side wall, and a second assembly including:

third and fourth elongated support strips spaced apart from one another, the third elongated support strip defining a third flange at a top end thereof and the fourth elongated strip defining a fourth flange at a top end thereof, one or more second elongated support rails secured transversely to and between the third and fourth support strips, the second assembly configured to be received within the transportation or storage container with the third and fourth flanges received on a top edge of another side wall thereof, opposite the one side wall, such that the second assembly is supported by the third and fourth flanges on and by the another side wall, and means for coupling the third and fourth flanges to the another side wall, wherein the one or more first elongated support rails and the one or more second elongated support rails are configured to support a plurality of dunnage pouches therebetween and slidable relative thereto.

15. The dunnage support assembly of claim 14, wherein the means for coupling the first and second flanges to the one side wall comprises:

a first elongated securement member affixed to, or configured to extend through, the first flange, and a second elongated securement member affixed to, or configured to extend through, the second flange, wherein the first and second elongated securement members are positioned to extend into corresponding first and second openings formed in the top edge of the one side wall as the first assembly is received within the transportation or storage container with the first and second flanges supported on the top edge of the one side wall.

16. The dunnage support assembly of claim 15, wherein the means for coupling the third and fourth flanges to the another side wall comprises:

a third elongated securement member affixed to, or configured to extend through, the third flange, and a fourth elongated securement member affixed to, or configured to extend through, the fourth flange, wherein the third and fourth elongated securement members are positioned to extend into corresponding third and fourth openings formed in the top edge of the another side wall as the second assembly is received within the transportation or storage container with the third and fourth flanges supported on the top edge of the another side wall.

17. The dunnage support assembly of claim 14, wherein the means for coupling the first and second flanges to the one side wall comprises:

a first elongated pin affixed to the first flange so as to extend downwardly away from a downwardly-facing surface of the first flange, and a second elongated pin affixed to the second flange so as to extend downwardly away from a downwardly-facing surface of the second flange, and wherein the means for coupling the third and fourth flanges to the another side wall comprises:

a third elongated pin affixed to the third flange so as to extend downwardly away from a downwardly-facing surface of the third flange, and a fourth elongated pin affixed to the fourth flange so as to extend downwardly away from a downwardly-facing surface of the fourth flange, wherein the first and second elongated pins are positioned to extend into corresponding first and second openings formed in the top edge of the one side wall as the first assembly is received within the transportation or storage container with the first and second flanges supported on the top edge of the one side wall, and wherein the third and fourth elongated pins are positioned to extend into corresponding third and fourth openings formed in the top edge of the other side wall as the second assembly is received within the transportation or storage container with the third and fourth flanges supported on the top edge of the another side wall.

18. The dunnage support assembly of claim 14, wherein the means for coupling the first and second flanges to the one side wall comprises:

a first opening defined through the first flange, a first elongated securement member having a first shaft portion sized to be received through the first opening, and a first head portion sized larger than the first opening such that, with the first shaft portion extending through the first opening, the first head portion is prevented from passing through the first opening, a second opening defined through the second flange, and a second elongated securement member having a second shaft portion sized to be received through the second openings, and a second head portion sized larger than the second opening such that, with the second shaft portion extending through the second opening, the second head portion is prevented from passing through the third opening, wherein the first and second openings defined through the first and second respective flanges are positioned so as to align with first and second respective openings formed in the top edge of the one side wall as the first assembly is received within the transportation or storage container with the first and second flanges supported on the top edge of the one side wall, such the first and second shaft portions of the first and second respective elongated securement members will pass through the first and second respective openings defined through the first and second respective flanges and into the first and second respective openings formed in the top edge of the one side wall so as to secure the first and second flanges to the top edge of the one side wall.

19. The dunnage support assembly of claim 18, wherein the means for coupling the third and fourth flanges to the another side wall comprises:

a third opening defined through the third flange, a third elongated securement member having a third shaft portion sized to be received through the third opening, and a third head portion sized larger than the third opening such that, with the third shaft portion extending through the third opening, the third head portion prevented from passing through the third opening, a fourth opening defined through the fourth flange, and a fourth elongated securement member having a fourth shaft portion sized to be received through the fourth openings, and a fourth head portion sized larger than the fourth opening such that, with the fourth shaft portion extending through the fourth opening, the fourth head portion is prevented from passing through the fourth opening, wherein the third and fourth openings defined through the third and fourth respective flanges are positioned so as to align with third and fourth respective openings formed in the top edge of the another side wall as the second assembly is received within the transportation or storage container with the third and fourth flanges supported on the top edge of the another side wall, such the third and fourth shaft portions of the third and fourth respective elongated securement members will pass through the third and fourth respective openings defined through the third and fourth respective flanges and into the third and fourth respective openings formed in the top edge of the another side wall so as to secure the third and fourth flanges to the top edge of the another side wall.

20. The dunnage support assembly of claim 19, wherein each of the first, second, third and fourth openings defined through the first, second, third and fourth respective flanges is countersunk such that, with the shaft portion of the respective first, second, third, and fourth elongated securement member extending therethrough and the respective first, second, third and fourth head portion supported against the respective first, second, third and fourth flange, a top surface of each of the first, second, third and fourth head portions is co-planar with, or extends below, a plane defined by a top surface of the respective first, second, third and fourth flange.

* * * * *